US009242359B2

(12) United States Patent
Staples et al.

(10) Patent No.: US 9,242,359 B2
(45) Date of Patent: Jan. 26, 2016

(54) FASTENING TOOL WITH DUAL PNEUMATIC HANDLES

(71) Applicant: Stanley Fastening Systems, L.P., North Kingstown, RI (US)

(72) Inventors: Kevin Staples, Surrey (GB); Luigi Arnaldo Paiella, Seveso (IT); Gianpaolo Scabin, Lissone (IT); Keven E. Miller, Wyoming, RI (US); I-Hui Liu, Taichung (TW)

(73) Assignee: STANLEY FASTENING SYSTEMS, L.P., North Kingstown, RI (US)

( * ) Notice: Subject to any disclaimer, the term of this patent is extended or adjusted under 35 U.S.C. 154(b) by 512 days.

(21) Appl. No.: 13/782,352

(22) Filed: Mar. 1, 2013

(65) Prior Publication Data

US 2013/0228606 A1 Sep. 5, 2013

Related U.S. Application Data

(60) Provisional application No. 61/606,145, filed on Mar. 2, 2012.

(51) Int. Cl.
*B25C 1/04* (2006.01)
*B25F 5/02* (2006.01)

(52) U.S. Cl.
CPC .. *B25C 1/04* (2013.01); *B25F 5/026* (2013.01)

(58) Field of Classification Search
CPC ..... B25C 1/04; B25C 1/047
USPC ..... 227/8, 9; 173/18; 16/422, 903, 426
See application file for complete search history.

(56) References Cited

U.S. PATENT DOCUMENTS 2,818,570 A 1/1958 Faccou
3,601,300 A * 8/1971 Anstett ..... B25C 1/044 227/130
3,893,610 A * 7/1975 Smith ..... B25C 1/041 227/116
3,939,925 A * 2/1976 Danielson ..... B25D 9/26 173/170
4,402,369 A * 9/1983 Nikitin ..... B25D 17/11 173/162.1
4,715,203 A * 12/1987 Wiegenstein ..... B23P 9/025 173/169
4,736,879 A * 4/1988 Yamada ..... B25C 1/041 227/130
4,907,730 A * 3/1990 Dion ..... B25C 1/008 227/130
5,318,637 A * 6/1994 Wernicke ..... B01F 15/00025 134/22.11
5,645,208 A * 7/1997 Haytayan ..... B25C 1/043 227/130
5,653,140 A * 8/1997 West ..... B25F 5/006 72/407
5,881,822 A * 3/1999 Sienkiewycz ..... B25D 17/043 173/162.2
5,885,351 A * 3/1999 Long ..... B05B 5/047 118/308
5,913,370 A * 6/1999 Chapelle ..... B25F 5/001 173/169
6,095,392 A * 8/2000 Batts, Jr. ..... B25C 1/008 227/130
6,155,472 A * 12/2000 Deziel ..... B25C 1/042 227/130
6,220,496 B1 * 4/2001 Hirai ..... B25C 1/047 227/130

(Continued)

FOREIGN PATENT DOCUMENTS

EP 0455618 A1 11/1991
GB 2433714 A 7/2007

(Continued)

OTHER PUBLICATIONS

Dewaele, Karl—European Search Report—May 8, 2014—5 pages—The Hague.

*Primary Examiner* — Gloria R Weeks
(74) *Attorney, Agent, or Firm* — Rhonda L. Barton

(57) ABSTRACT

A fastening tool having plural power source ports that, when contemporaneously activated, deliver compressed air to a fastener driving assembly to drive a fastener into a workpiece.

14 Claims, 28 Drawing Sheets

(56) References Cited

U.S. PATENT DOCUMENTS 6,572,000 B2 * 6/2003 Hirai ..... B25C 1/04 227/130
6,926,186 B2 8/2005 Wells
7,131,180 B2 * 11/2006 Kopras ..... B25F 3/00 144/136.95
7,278,561 B2 * 10/2007 Schnell ..... B25C 1/008 227/10
7,392,568 B2 * 7/2008 Koschel ..... B25F 5/026 16/426
7,510,105 B2 * 3/2009 Moeller ..... B25C 1/08 123/46 SC
7,533,663 B2 * 5/2009 Gan ..... F41B 11/721 124/70
7,540,068 B2 * 6/2009 Powell ..... B23D 47/00 16/246
7,637,406 B2 * 12/2009 Deng ..... B25C 1/04 227/112
7,721,390 B2 * 5/2010 Pfeiffer ..... B25D 17/043 16/426
8,132,296 B2 * 3/2012 Di Nicolantonio ..... B25F 5/026 16/246
8,166,614 B2 * 5/2012 Martin ..... B25F 5/026 16/422
8,444,035 B2 * 5/2013 Coleman, Jr. ..... B25C 1/043 173/169
9,057,482 B2 * 6/2015 Hung ..... F16N 5/02
2003/0136571 A1 * 7/2003 Linberg ..... B25D 17/30 173/162.2
2012/0043364 A1 * 2/2012 Coleman, Jr. ..... B25C 5/13 227/8
2013/0313051 A1 * 11/2013 Hung ..... F16N 5/02 184/41

FOREIGN PATENT DOCUMENTS

JP 2000263472 A 9/2000
JP 2001047377 A 2/2001
TW I352652 B 11/2011

* cited by examiner

FASTENING TOOL WITH DUAL PNEUMATIC HANDLES

CROSS REFERENCE TO RELATED APPLICATION

The present application claims priority under 35 U.S.C. §119 to U.S. Provisional Application Ser. No. 61/606,145 filed on Mar. 2, 2012, which is herein incorporated by reference in its entirety.

BACKGROUND OF THE INVENTION

1. Field of the Invention

The present invention relates, in general, to the field of fastening tools. In particular, the present invention relates to fastening tools having plural sources of power channeled through plural handles, and more particularly to a fastening tool for industrial applications such as the manufacture of pallets, used in the shipping and handling of commercial of goods.

Pallets are constructed by assembling wood boards in the form of a frame having at least one, and normally two, supporting surfaces or platforms which are spaced by beams or runners which extend perpendicular to the supporting surfaces in spaced relation. In the manufacture of wooden pallets, the boards which form the supporting surfaces at both the top and bottom of the pallet are spaced at desired intervals along such surface and fastened to the beams or runners to form a rigid frame assembly. In addition to wood, pallets can be made from plastic, metal, and paper. Fastening tools are used to join boards together to form a pallet.

2. Description of the Related Art

Pneumatic fastening tool development has been directed toward designing fastening tools that are for use with one hand. Therefore, a movement in the pneumatic fastening tool field is to design new tools that are smaller and lighter in weight, yet still maintain the driving power of traditional and older pneumatic fastening tools. The design of lightweight pneumatic fastening tools for single-handed fastening is in response to tool users' need to position, with their free hand, workpieces to be fastened together.

In industrial environments, however, such as the pallet fabrication and repair industry, the user does not need to use their free hand to position workpieces to be fastened together, because workpieces are arranged through automation. As a result, the free hand is idle and at risk of injury or being involved in a workplace accident, as the free hand is not required for use in the industrial fabrication operation. Adding a second handle that provides a control mechanism for operation of the tool requires both hands to be on the tool, thereby reducing the risk of injury in an industrial workplace accident.

A second handle has been used on existing large or heavy hand-held pneumatic fastening tools so that both hands of the user can be used to balance the tool and position the tool more easily. However, as a second handle is not required for actual operation, these existing tools can be operated with a single hand. A second handle for balancing the tool that is not required for operating the tool, is generally referred to as a "dead" handle. Dead handles do not require that both hands be on the tool for operation of the tool.

Taiwan Patent Application No. 1352652, which is herein incorporated by reference in its entirety, discloses a tool 1000 having a first handle 1002 and a second 1004 that controls air supply into the fastening tool for operation of the tool. Such an active second handle 1004 is generally referred to as a "live" handle. The second handle 1004, as shown in FIG. 1, is a live handle located in the air supply path of the tool and includes a manually operated pneumatic valve controlled by a lever 1006 that renders the tool non-operational unless the second handle 1004 is grasped and the lever 1006 is pulled to activate the valve. The valve opens to supply compressed air into the tool. FIG. 2 is a functional schematic of the tool operation with the second handle 1004. The schematic shows how the tool activation is dependent upon both of the users' hands controlling two separate valves in addition to engaging the work contact element with the workpiece to operate the tool 1000. The two separate valves are a first handle trigger valve 1008 and a second handle trigger valve 1010.

One of the challenges of having an auxiliary handle is providing a sufficient supply of compressed air to the tool for operation with varying air system environments and fastening rates. The live handle must be designed so that the force to activate the valve is within a range that is not fatiguing to the user. Also, the live handle body must be ergonomically designed to reduce grasp fatigue. The above design considerations result in an upper limit to the air flow rate through the auxiliary handle which can lead to functional problems when a higher air flow rate is required.

The functional schematic of FIG. 2 shows the external connections between elements of the fastener assembly shown in FIG. 1. When the live handle is released, the volume of compressed air in the tool reservoir 1012 is completely exhausted. As a result, the tool 1000 has a higher air consumption necessitating a higher capacity air compressor.

SUMMARY OF THE INVENTION

The tool is a pneumatic fastening tool that has two handles. The first or main handle is arranged to receive compressed air and direct the air into the housing assembly when a trigger is pulled to actuate a piston that drives a driver within the housing assembly. The driver engages the head of a fastener or fastener within the tool and drives the fastener into a workpiece. A second handle is mounted to the tool and includes an air hose to direct another source of compressed air into the tool housing assembly. The second handle includes a lever that when pulled with the user's second hand, opens a port to admit compressed air through the second handle and to the tool housing assembly. The piston in the housing assembly is actuated when the lever is pulled with a user's second hand, the trigger is depressed with the user's first hand and the contact trip is pressed against a workpiece to drive a fastener. As such, both hands of the user are engaged with the handles of the tool and away from the workpiece and fastener nose, thereby minimizing the risk of injury in an industrial workplace accident.

The present invention also provides an improved ergonomic structure in such industrial environments that allows repetitive and industrial speed fastening with large pneumatic fastening tools. A large pneumatic fastening tool performing industrial speed fastening in an industrial facility operates at a higher speed than a transportable, non-location specific fastening tool.

The present invention also includes embodiments in which reduced air consumption by a tool having an auxiliary handle for supplying air is disclosed.

An objective of this invention is to increase the compressed air flow rate to the tool without adversely effecting ergonomics and productivity.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

The numerous advantages of the present invention may be better understood by those skilled in the art by reference to the accompanying Figures. In the drawings, like reference numerals designate corresponding parts throughout the several views.

FIGS. 17-1 to 17-2 are cross-sectional views of a check valve;

DETAILED DESCRIPTION OF THE INVENTION

Reference will now be made in detail to the presently preferred embodiments of the invention, examples of which are illustrated in the accompanying drawings.

Figure 3:
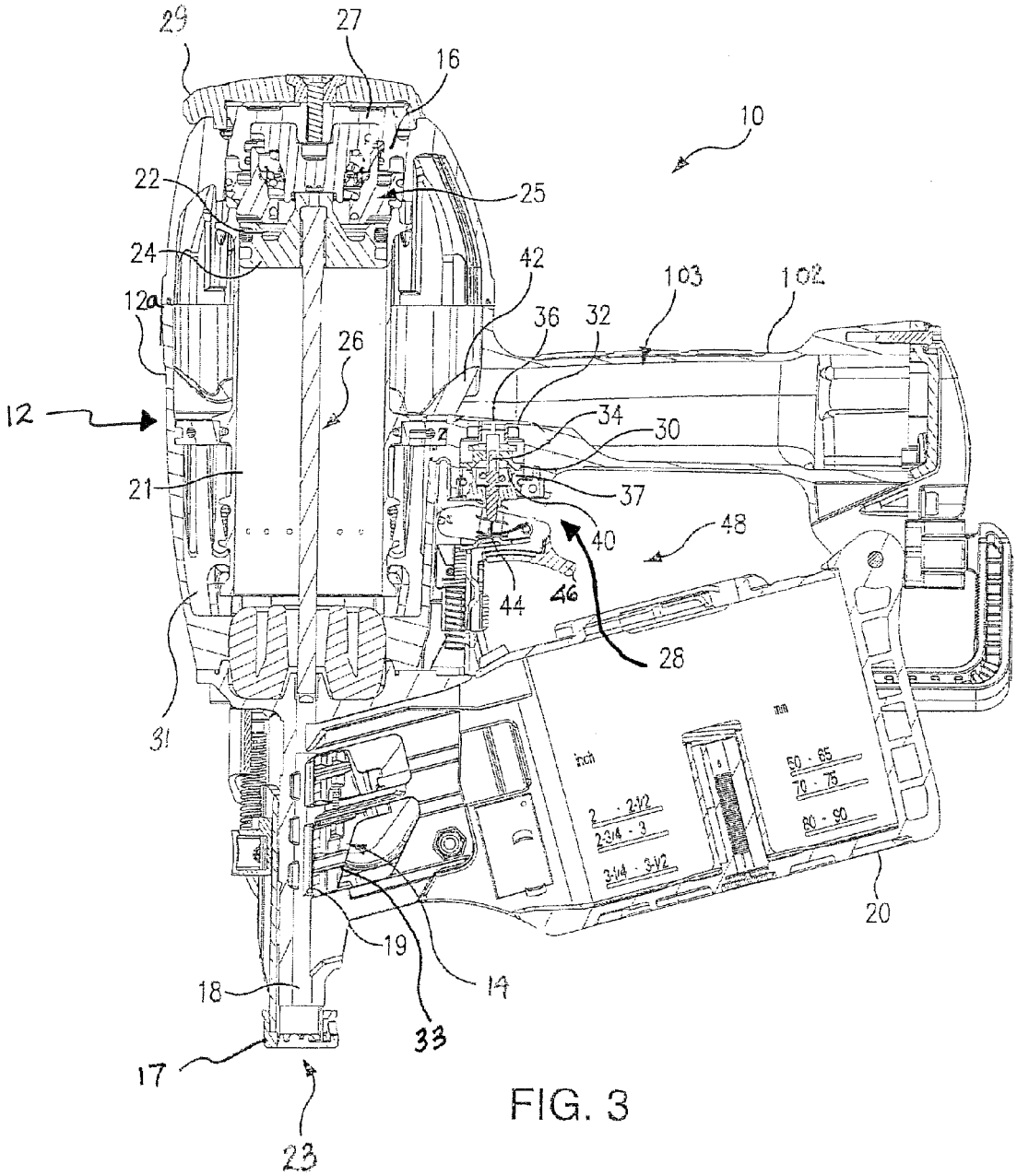
FIG. 3 is an exemplary cross-sectional view of an embodiment of the tool of the present invention.

Referring now more particularly to the drawings, a pneumatically operated fastening tool, generally indicated at 10, is shown in FIG. 3, which embodies the principles of the present invention. The tool 10 includes a housing assembly, generally indicated at 12, which includes a main handle 102 of hollow configuration which constitutes a tool reservoir 103 for supply air under pressure coming from a source which is communicated therewith. The housing assembly 12 further includes a nose piece 17 defining a fastener drive track 18 adapted to receive laterally therein a leading fastener 19 from a package of fasteners mounted within a fastener magazine, generally indicated at 20. The magazine 20 is of conventional construction and operation. A feed pawl 14 is provided to pull successive nails from the magazine forward toward the nose portion of the tool. The nose piece 17 includes a contact trip 23 constructed and arranged to be moved from a normally biased inoperative position into an operative position when pressed against a workpiece.

The housing assembly 12 includes a housing body 12*a* having a longitudinal axis. The housing assembly 12 also includes a fastener driving assembly that includes a cylinder 21 and a piston 24 that reciprocates within the cylinder to drive a fastener. The cylinder 21 is disposed within the housing body 12*a* and extends along the longitudinal axis thereof, and has an upper end 22 disposed in communicating relation with the main valve reservoir 16. A piston 24 is slidably and sealingly mounted in the cylinder 21 for movement through repetitive cycles each of which includes a drive stroke and a return stroke. A fastener driving element 26 is operatively connected to the piston 24 and is slidably mounted within the fastener drive track 18. The fastener driving element 26 is movable by the piston 24 through a drive stroke in response to the drive stroke of the piston and a return stroke in response to the return stroke of the piston. During the drive stroke, the fastener driving element 26 engages a fastener within the fastener drive track 18 and moves the same along a longitudinal axis outwardly through the nosepiece 17 and into a workpiece. A jam-release door 33 can be provided to remove fasteners that are jammed in the fastener drive track of the tool. A main piston return reservoir 31 is provided in the housing. A housing cap is provided on the housing body 12*a* at an end longitudinally opposite to that of the nose piece 17.

A main valve, generally indicated at 25, is provided for controlling communication of the supply air to the upper end 22 of the cylinder 21 to effect the driving movement of the piston 24 and the fastener driving element 26. The main valve 25 is pilot pressure operated and the pilot pressure chamber 27 thereof is under the control of an actuating valve mechanism, such as the first or main handle trigger valve, generally indicated at 28. Means are provided within the housing assembly 12 to effect the return stroke of the piston 24. For example, such means may be in the form of a conventional plenum chamber return system such as disclosed in U.S. Pat. No. 3,708,096, the disclosure of which is hereby incorporated by reference into the present specification.

The first handle trigger valve 28 is conventional and of the type disclosed in U.S. Pat. No. 5,083,694, the disclosure of which is hereby incorporated by reference into the present specification. The trigger valve 28 includes a valve housing 30 sealingly engaged within a recess 32 formed in the main handle 102 of the housing assembly 12. Mounted within the valve housing 30 is a tubular valve member 34. The tubular valve member 34 is resiliently biased by a spring 37 into a normally inoperative position as shown in FIG. 3, wherein a supply of air under pressure within the main handle 102 of the housing assembly 12 can pass through an inlet opening 36 in the valve housing 30, in and around the tubular valve member 34, through the central openings 40 in the valve housing 30 and into a passage 42. The passage 42 communicates with the pilot pressure chamber 27 for the main valve 25. When the pilot pressure chamber 27 is exposed to high pressure, the main valve 25 is in a closed position. The main valve 25 is pressure biased to move into an open position when the pressure in the pilot pressure chamber 27 is relieved. The pilot pressure is relieved when the tubular valve member 34 moves from the inoperative position into an operative position discontinuing the communication of pressure in the main valve reservoir 16 with the pilot pressure chamber 27 and exhausting pressure in the pilot pressure chamber 27 to atmosphere. This movement is under the control of an actuator 44 which is mounted for rectilinear movement in a direction toward and away from a trigger assembly, generally indicated at 48. The trigger assembly 48 includes trigger 46, which when depressed, pushes the actuator 44 from an inoperative position to an operative position.

Figure 4:
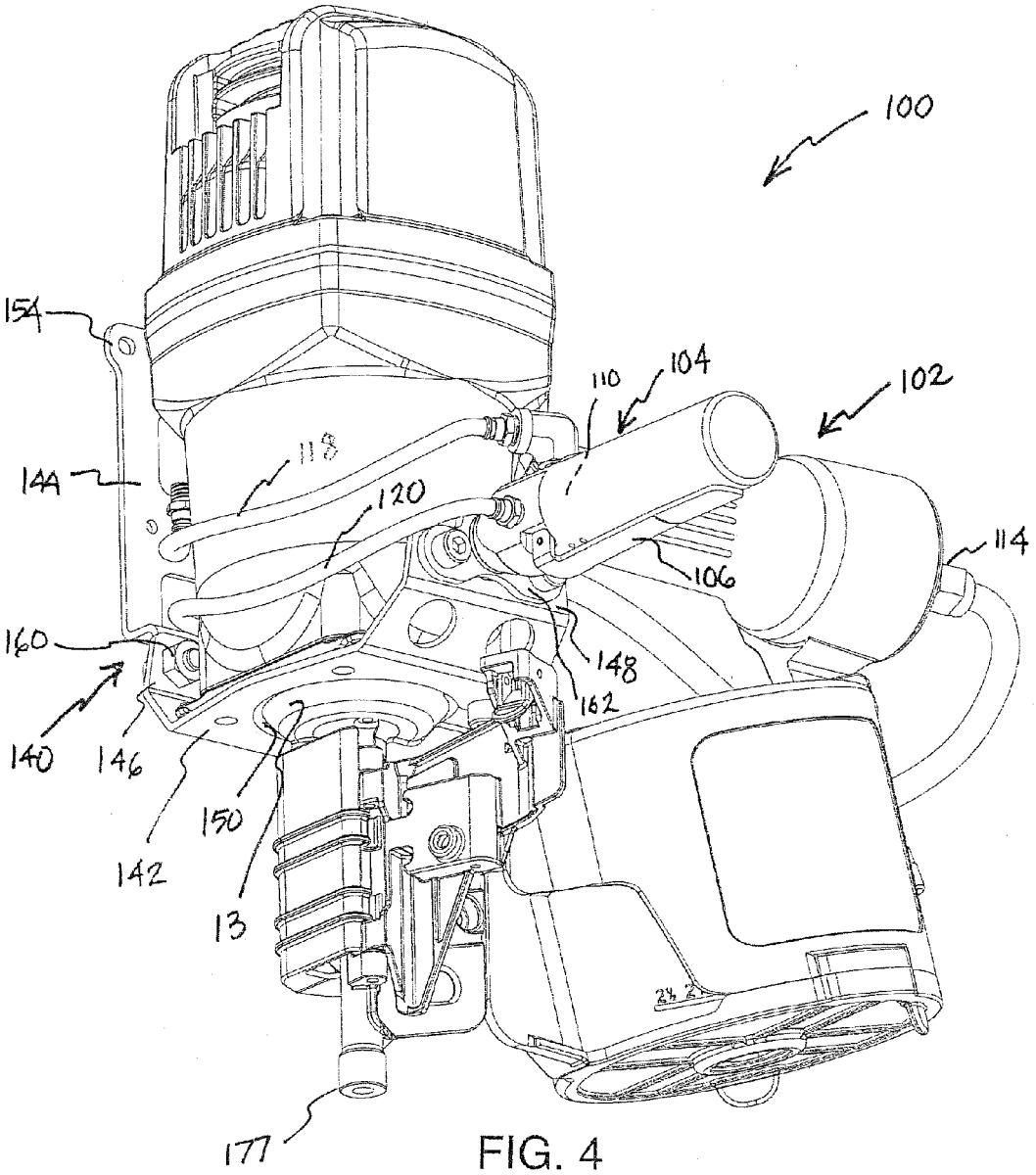
FIG. 4 is a front perspective view of an embodiment of the tool having an auxiliary handle and control valve.
Figure 5:
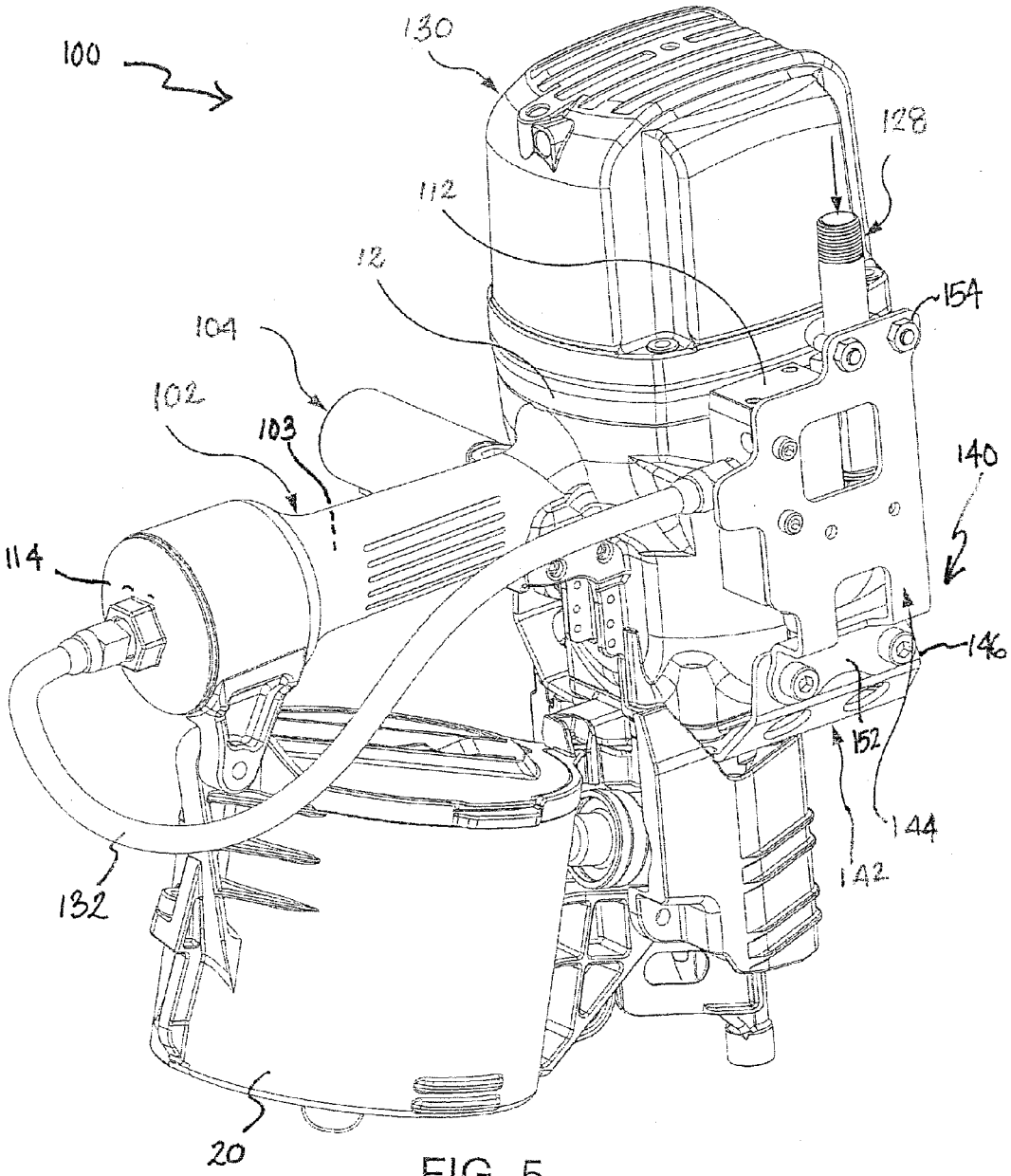
FIG. 5 is a rear perspective view of an embodiment of the tool of FIG. 4.
Figure 6:
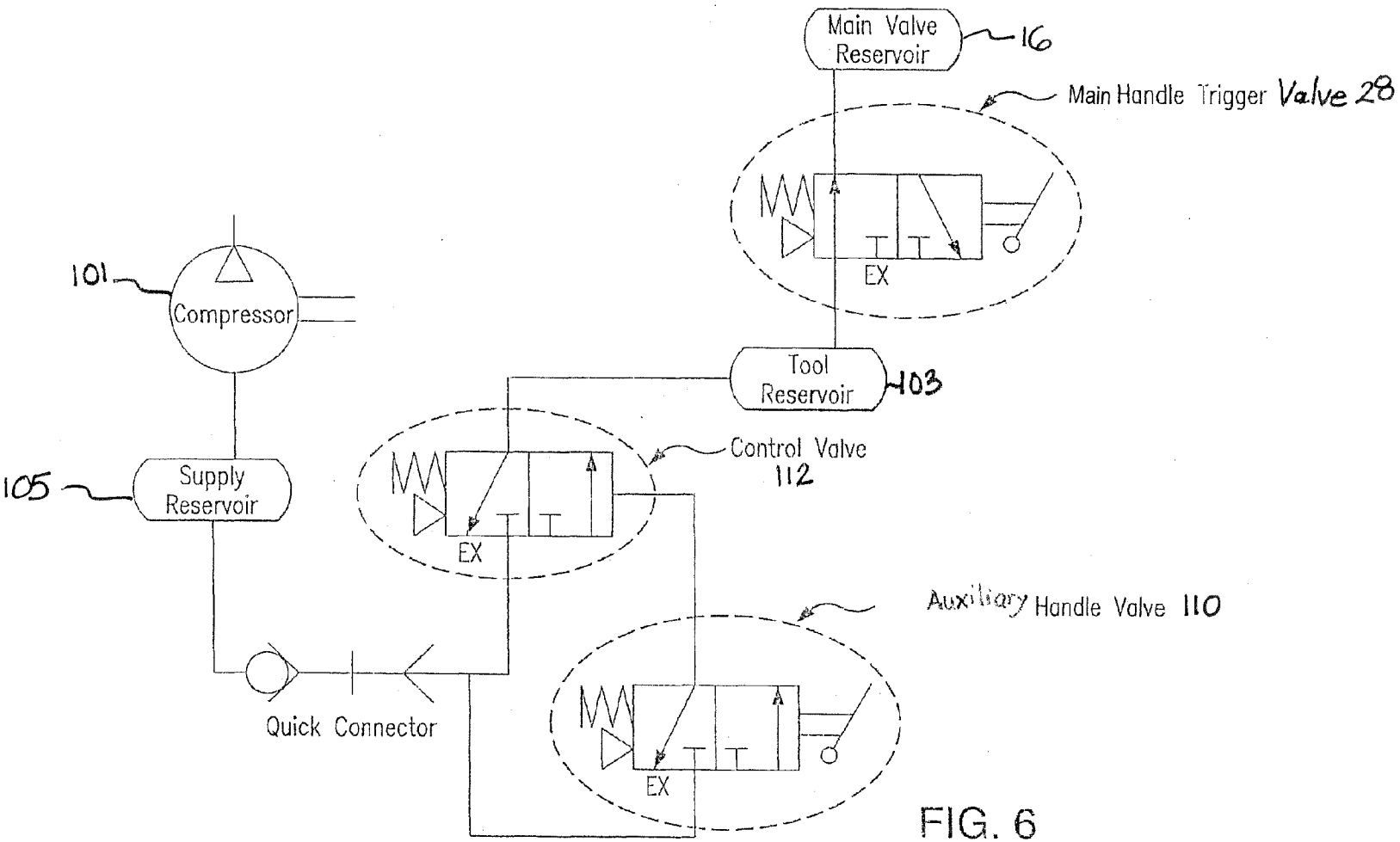
FIG. 6 is a functional schematic of an embodiment of the tool of FIG. 4.

FIGS. 4-6 illustrate the fastening tool having a plurality of handles for supplying a compressed gas, such as air, to the nose thereof to power the fastener driving element to drive a fastener into a workpiece. FIGS. 4-6, in particular, illustrate a dual handle pneumatic fastening tool according to embodiments of the present invention. Like reference numerals indicate like parts in the Figures. The tool 100 includes the pneumatic operating system of the tool 10 shown in FIG. 3. The tool 100 also includes the first or main handle 102, such as a standard handle of a pneumatic fastening tool. The main handle 102 includes a tool reservoir 103 for introducing a compressed gas, such as air, into the housing cylinder 21. The tool further includes a second or auxiliary handle 104 connected to an air inlet 128 through which air is supplied to the tool 100 from a compressor 101. A lever 106 is operatively connected to the auxiliary handle 104, such that when the lever is pulled, a valve 110 in the auxiliary handle is opened to supply air to the tool.

Referring to FIGS. 4-6, the fastening tool 100 is equipped with an air pilot-operated flow control valve 112 and a main air flow control valve 114 that receives compressed air from the auxiliary handle 104. The auxiliary handle 104 can receive compressed air from the air inlet 128 connected to the air compressor 101 via a hose 118. The flow control valve 112 directly supplies air flow to the tool reservoir 103. The flow control valve 112 is a pilot-operated control valve, having a high volumetric flow rate, sufficient to supply air to the tool for high nailing rates, such as for example only, about 5 cycles per second or more. The flow control valve 112 is in communication with the auxiliary handle 104 so that air from the compressor can be routed through the auxiliary handle 104 to control the pilot of the flow control valve 112. The flow control valve 112, in turn, controls whether air flow is routed through to the tool reservoir 103 or is exhausted from the tool.

The flow control valve or control valve 112 includes a pilot actuator, such as a piston, that is controlled by the air entering the auxiliary hose 120 from the auxiliary handle 104. As shown in FIGS. 4 and 6, the auxiliary handle 104 controls the volume of compressed air supplied to the pilot actuator of the control valve 112. The control valve 112 then controls the supply of compressed air that enters the housing body and housing cylinder 21 through the main air flow valve 114 and the main handle 102. As a result, the flow rate of compressed air to the housing cylinder 21 of the present invention can be increased to a rate higher than flow rates in fastening tools, such as in the tool illustrated in FIG. 1, in which the compressed air flows directly from an auxiliary handle 1004 to a main handle 1002. The increase in flow rate in the tool of the present invention is attributable to the control valve 112 being larger than the valve 110 in the auxiliary handle 104. As a result, for the same air compressor operating pressure as in the existing tool, the user of the tool of the present invention can exert less force on the auxiliary handle lever 106 to open the auxiliary handle valve and achieve the required flow rate. Accordingly, the ergonomics of the tool is improved over existing fastening tools, such as that shown in FIG. 1.

FIG. 5 illustrates one embodiment of the orientation and mounting of the control valve 112 that incorporates an air inlet 128 parallel to the housing body 12*a* of the housing assembly 12. In industrial applications, fastening tools can be hung from a gantry by a cap 130 of the tool and are often counter balanced. The air supply hose from the air compressor to the control valve 112 can be routed along the counter balance line. Accordingly, the hose connection 132 from the control valve 112 to the fastening tool is easily accessible.

FIG. 6 illustrates a functional schematic of an embodiment shown in FIG. 5. As shown in FIG. 6, air from an air compressor 101 having a compressor tank or supply reservoir 105, flows to the control valve 112 and to the auxiliary handle 104. The compressed air flow from the auxiliary handle 104 also flows to the control valve 112. The combined air flow in the control valve 112 flows into the main handle 102 and then into the housing cylinder 21.

The auxiliary handle 104 of an embodiment of the present invention can be mounted to the housing assembly 12 at various points on the housing body 12*a*. The position of the auxiliary handle 104 on the housing body 12*a* can be tailored to the specific ergonomic need of the user and is thereby adjustable and repositionable. By tailoring the position of the auxiliary handle 104 to the user, the user is able to comfortably control and operate the tool and optimize productivity.

In this regard, the tool 100 is designed to accommodate different arrangements of the auxiliary handle to meet the ergonomic needs of a particular user. For example, a mounting bracket 140, as shown in FIGS. 4 and 5, can be provided. The mounting bracket 140 allows the auxiliary handle 104 to be positioned on either side of the housing body 12*a* to accommodate both left and right-handed users.

With reference to FIGS. 4 and 5, the mounting bracket 140 includes a first plate 142 and a second plate or valve cover 144. The first plate 142 can be formed of a rigid material having two opposing ends 146, 148 that are bent in a direction perpendicular to the plane of the first plate. The first plate 142 has an opening 150 centrally located between the first plate opposing ends 146, 148. The opening 150 cuts through one lateral side of the first plate 142 and is sized to fit around and be affixed to a base portion 13 of the housing body 12*a* of the housing assembly 12.

The valve cover 144 can also be formed of a rigid material having two opposing ends 152, 154. The first end 152 is proximal to and can be connected to the bent portions 146 of the first plate 142. The second end 154 is a free end that is distal from the first plate 142. The valve cover 144 serves to protect the control valve 112 from the application environment.

The auxiliary handle 104 is also attached to the mounting bracket 140 on an opposite side of the housing body 12*a* from the valve cover 144.

The first plate 142 of the mounting bracket 140 has integral screw mounts 160 for mounting an auxiliary handle mount 162 to the first end of the first plate 142 and for locating fitting screws on the second plate 144 to mount the second plate thereto. The first plate opposing ends 146, 148 are designed to accommodate the auxiliary handle 104 on one side of the housing body 12*a* of the housing assembly 12 and a second plate 144 on the other side of the housing body. The mounting bracket can be fixedly mounted to an outer side surface of the housing body 12*a* between the cap 130 and the base portion 13 of the housing body 12*a*. The receiving portion at the second end of the mounting bracket 140 extends from the mounted portion, across the lower portion of the housing and circumscribes the base portion 13 of the housing body 12*a*.

Figure 7:
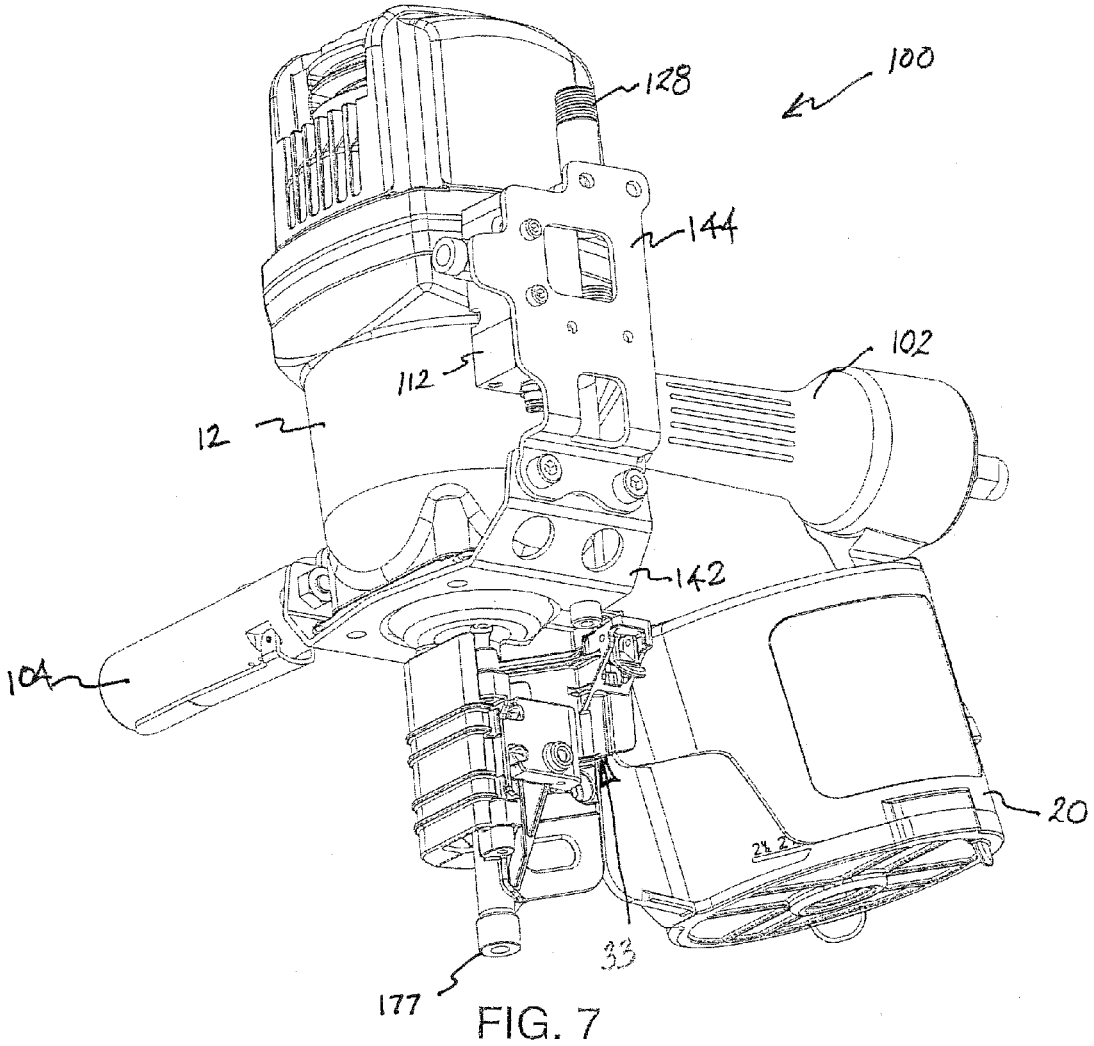
FIG. 7 is a front perspective view of another embodiment of the tool having an auxiliary handle and control valve.
Figure 8:
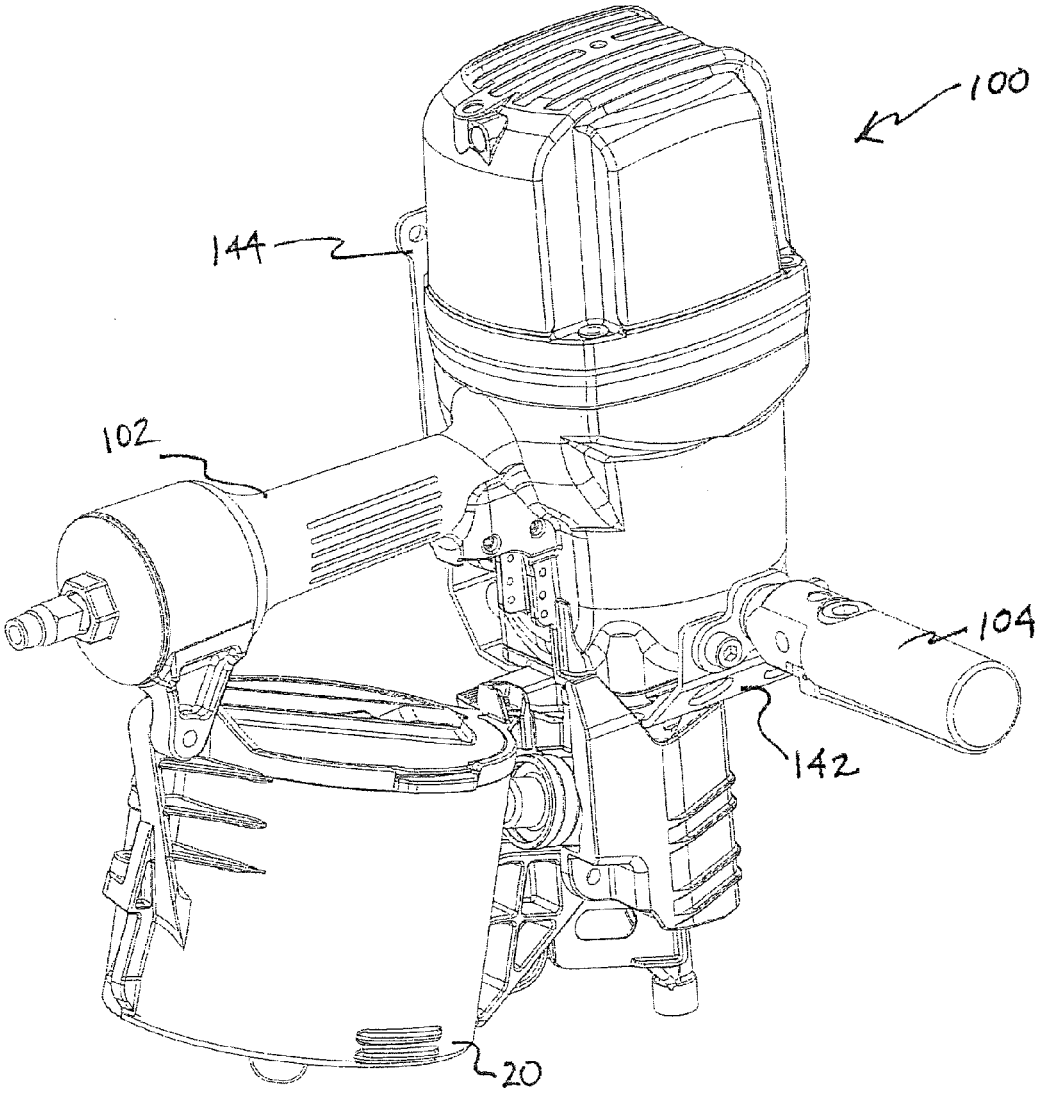
FIG. 8 is a rear perspective view of the tool of FIG. 7.

FIGS. 7-15 illustrate further embodiments in which the auxiliary handle 104 and control valve 112 can be arranged on the mounting bracket 140 that is attached to the housing body 12*a*. In the embodiment of FIG. 7, the second plate or valve cover 144 is disposed on a jam-release door side of the nosepiece 177 of the tool 100. The auxiliary handle 104 is mounted on the mounting bracket 140 on the opposing side of the jam-release door 33. FIG. 8 shows a rear side view of the tool of FIG. 7.

As shown in FIGS. 4 and 5, the auxiliary handle 104 is configured for a user who would place their right hand on the main handle 102 and the trigger 28 and place their left hand on the auxiliary handle. Conversely, as shown in FIGS. 7 and 8, the auxiliary handle 104 is configured for a user who would place their left hand on the main handle 102 and the trigger 28 and place their right on the auxiliary handle. In this regard, the configuration or position of the auxiliary handle is adjustable from one lateral side of the housing body 12*a* to the other side. In addition, the compressed air inlet 128 and flow control valve 112 can be repositioned to protect the air inlet from external forces and be positionable depending upon the particular tool support or gantry that is used.

Figure 9:
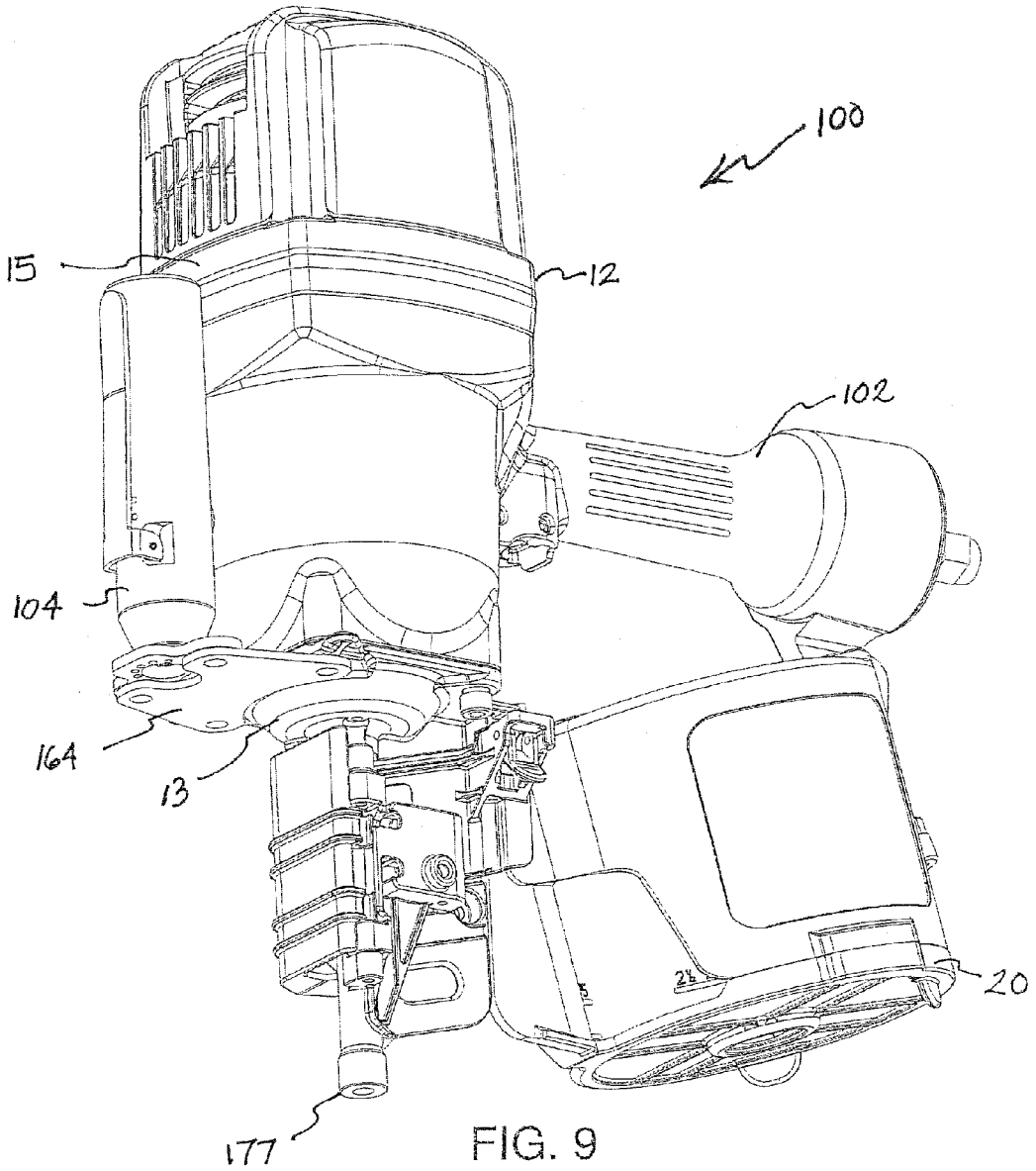
FIG. 9 is a front perspective view of an embodiment of the tool having a vertical auxiliary handle on the front of the tool.

FIGS. 9-12 illustrate different configurations of the auxiliary handle that provide a clear line of site to the nose piece 177 or fastener point. In FIG. 9, the auxiliary handle 104 is mounted forward of a forward face 15 of the housing body 12*a* on a side of the housing body 12*a* opposite to the main handle 102. The auxiliary handle 104 is mounted to a planar mounting bracket 164 attached to the base portion 13 of the housing body 12*a*.

Figure 10:
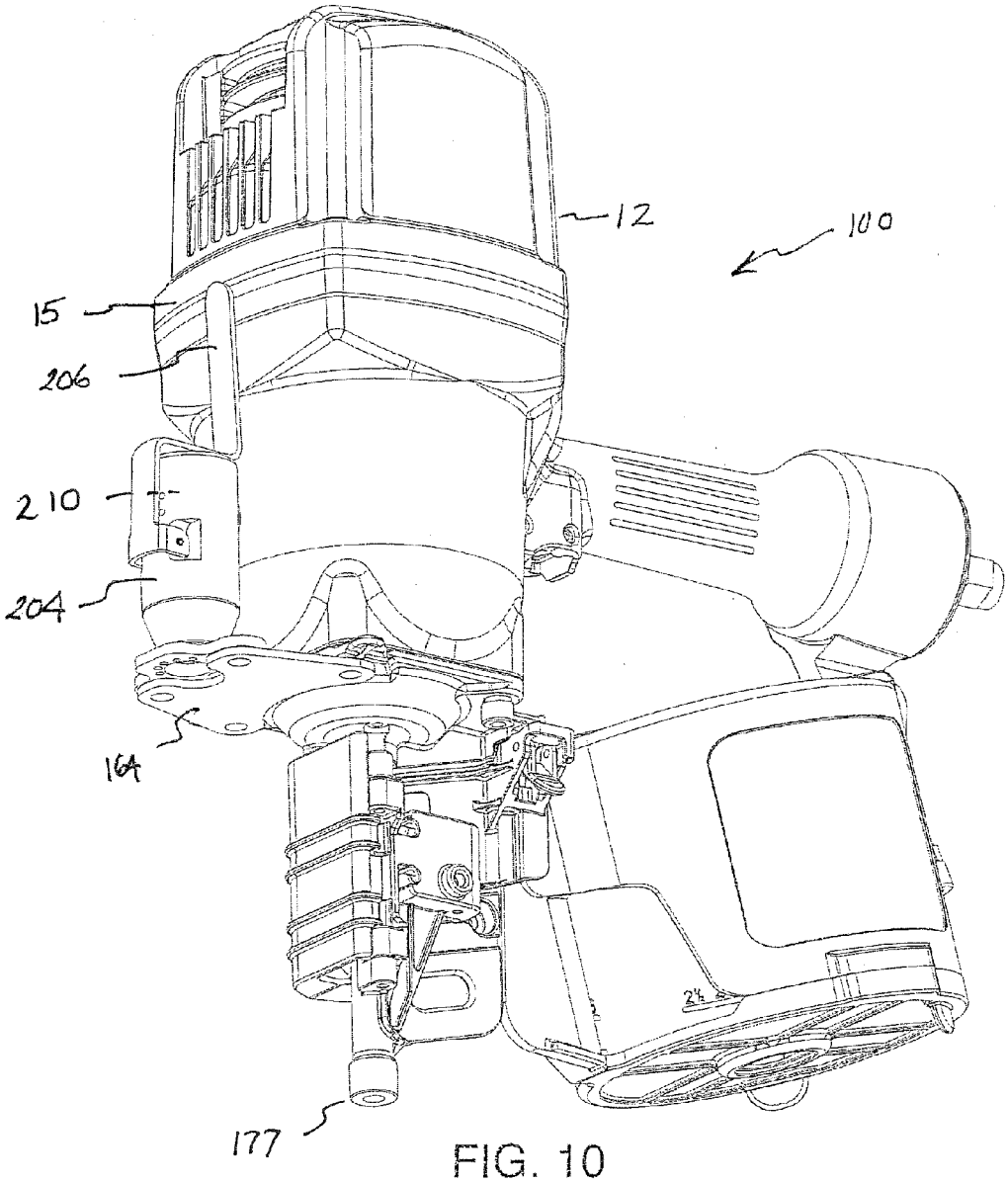
FIG. 10 is a front perspective view of an embodiment of the tool having an alternate vertical auxiliary handle on the front of the tool.

FIG. 10 illustrates a further embodiment of the auxiliary handle configuration. In FIG. 10, an alternative auxiliary handle 204 has a lever 206 that can be located parallel and adjacent to the housing body 12*a* of the housing assembly 12 so that when the user positions their free hand on the housing body 12*a* to balance the tool, the user can simultaneously press the lever 206 flush against the housing body to open the auxiliary handle valve 210 In practice, such a free hand position is desirable when using large industrial fastening tools that are not equipped with an auxiliary handle. The auxiliary handle 204 of FIG. 10 is in the same position as the auxiliary handle 104 shown in FIG. 9, but is smaller in size. The size of the auxiliary handle 204 in FIG. 10 is possible because the compressed air supply to the tool 100 is not routed through the longitudinal axis of the auxiliary handle valve as in existing fastening tools, such as that shown in FIG. 1. As such, the auxiliary handle valve 210 body size can be reduced.

Figure 11:
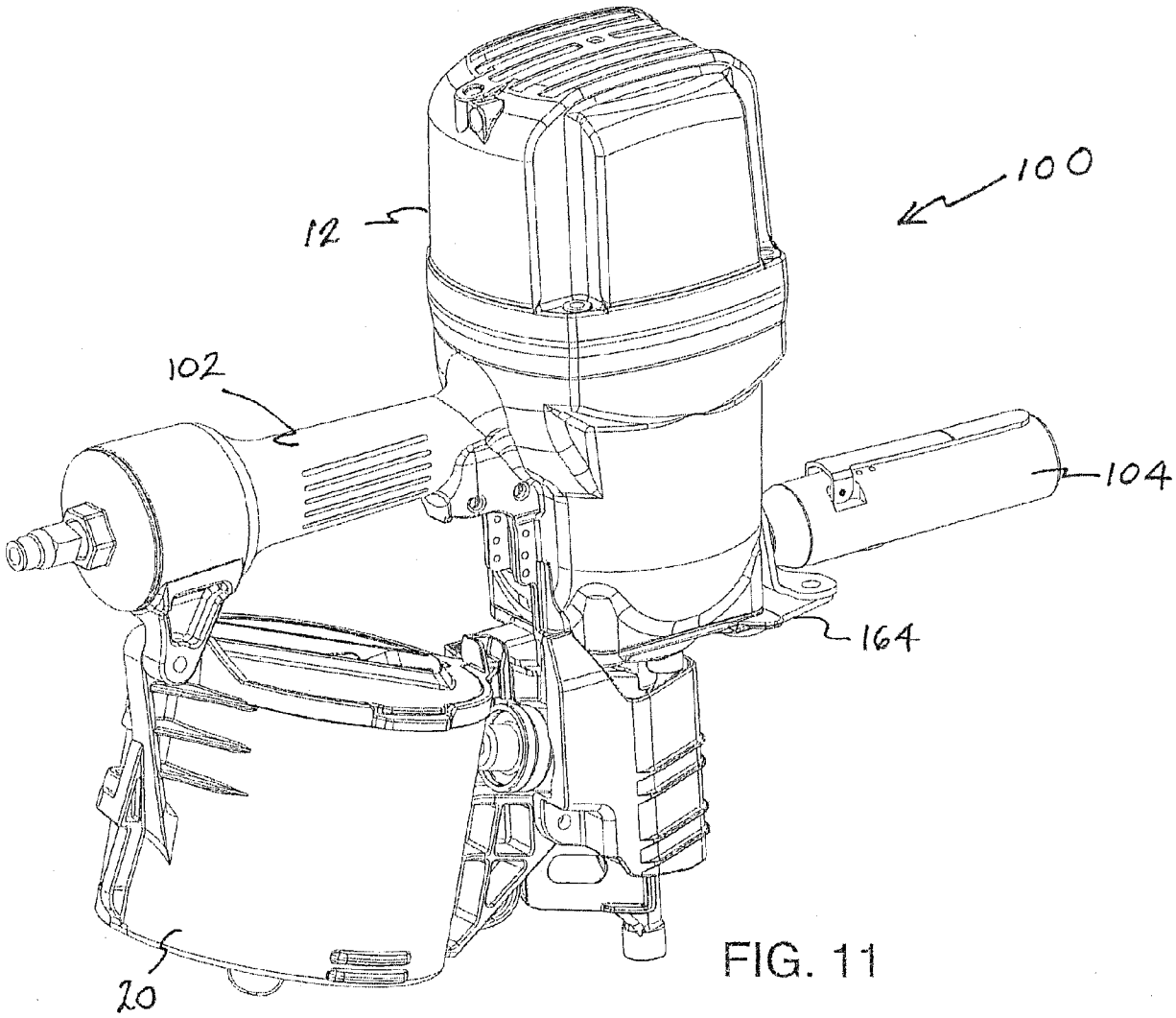
FIG. 11 is a rear perspective view of an embodiment of the tool having a horizontal auxiliary handle on the front of the tool.

FIG. 11 illustrates a further embodiment of the auxiliary handle configuration. In FIG. 11, the auxiliary handle 104 is mounted on a planar mounting bracket 164, such as that shown in FIGS. 9 and 10. The auxiliary handle 104 is positioned forward of the forward face 15 of the housing body 12*a* and in the same plane as the main handle 102. The position of the auxiliary handle in FIG. 11 allows the tool 100 to be held in a manner similar to that of holding a jackhammer.

Figure 12:
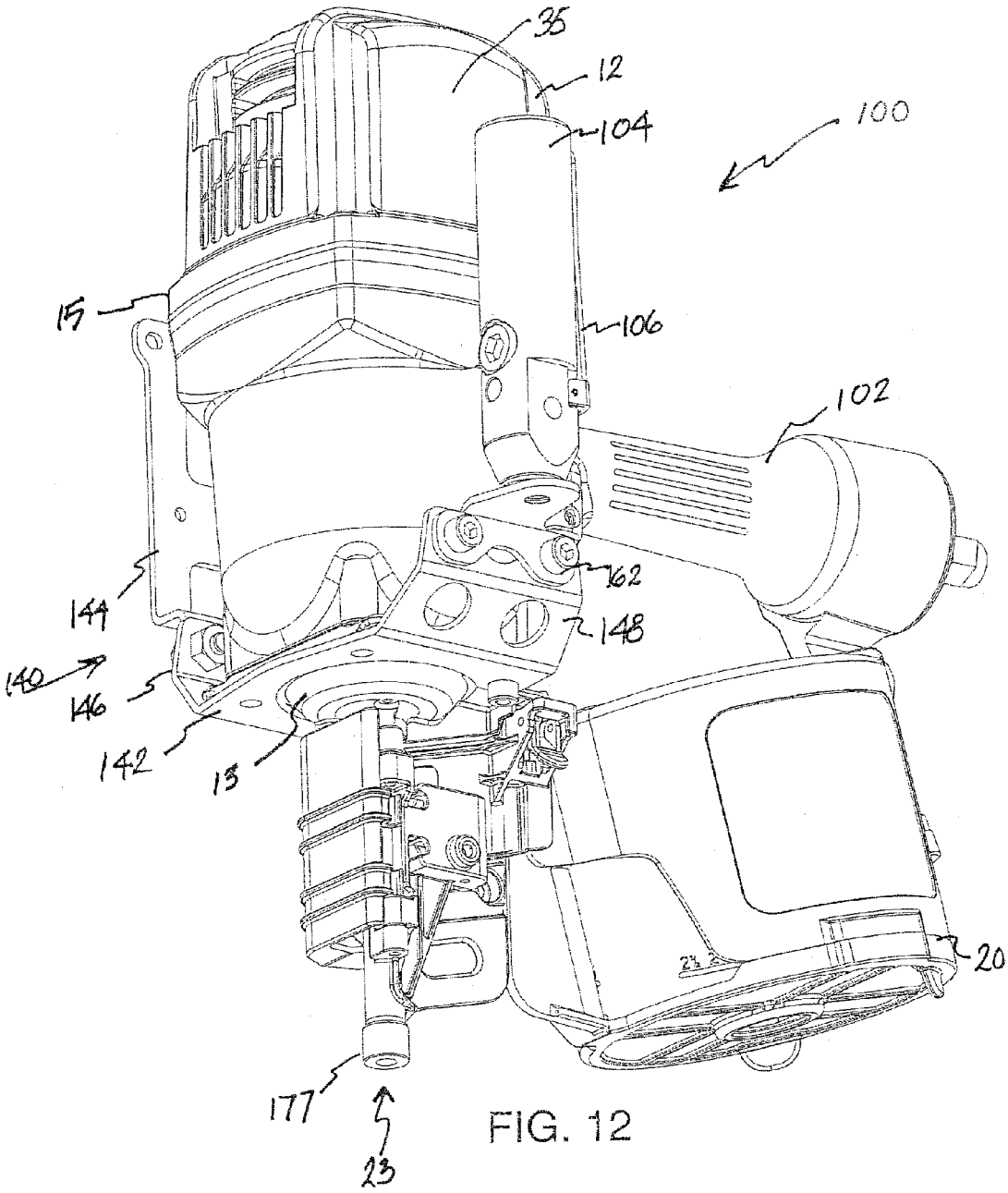
FIG. 12 is a front perspective view of an embodiment of the tool having an auxiliary handle behind and parallel to the main handle.

FIG. 12 illustrates a further embodiment of the auxiliary handle configuration. The auxiliary handle 104 is mounted on the mounting bracket 140 along a side face 35 of the housing body 12*a* in a position that is parallel to the longitudinal axis of the housing. In FIG. 12, the line of sight to the fastening tool nose piece 177 is unobstructed because the fastener exit through the contact trip 23 can be viewed by the user. As a result, productivity can be increased because the fastener can be placed more precisely on the workpiece.

Figure 13:
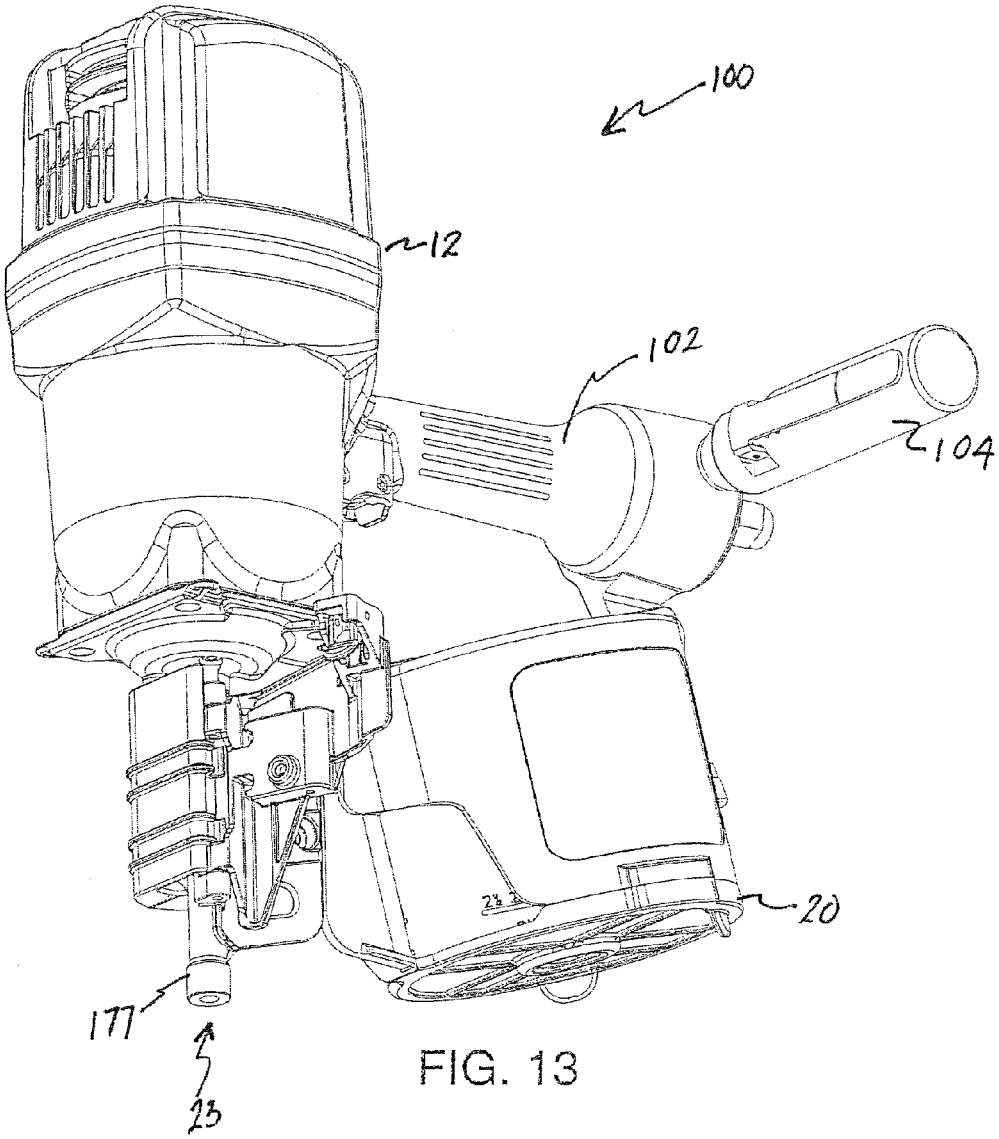
FIG. 13 is a front perspective view of an embodiment of the tool having an auxiliary handle orthogonal and behind the main handle.

The mounting bracket 140 can be positioned on any outer side portion of the housing body 12*a* such that the line of sight for the user to view the nose piece 177 and contact trip 23 during fastening operations can be maintained. In this regard, the auxiliary handle 104, can be mounted on the main handle 102, as shown in FIG. 13, so as to position the auxiliary handle away from and provide an unobstructed view to the nosepiece 177. In FIG. 13, the line of sight to the fastening tool nose is unobstructed as the auxiliary handle 104 is mounted to the base of the main handle 102. Specifically, the auxiliary handle is mounted to the end cap behind the main handle 102.

Figure 14:
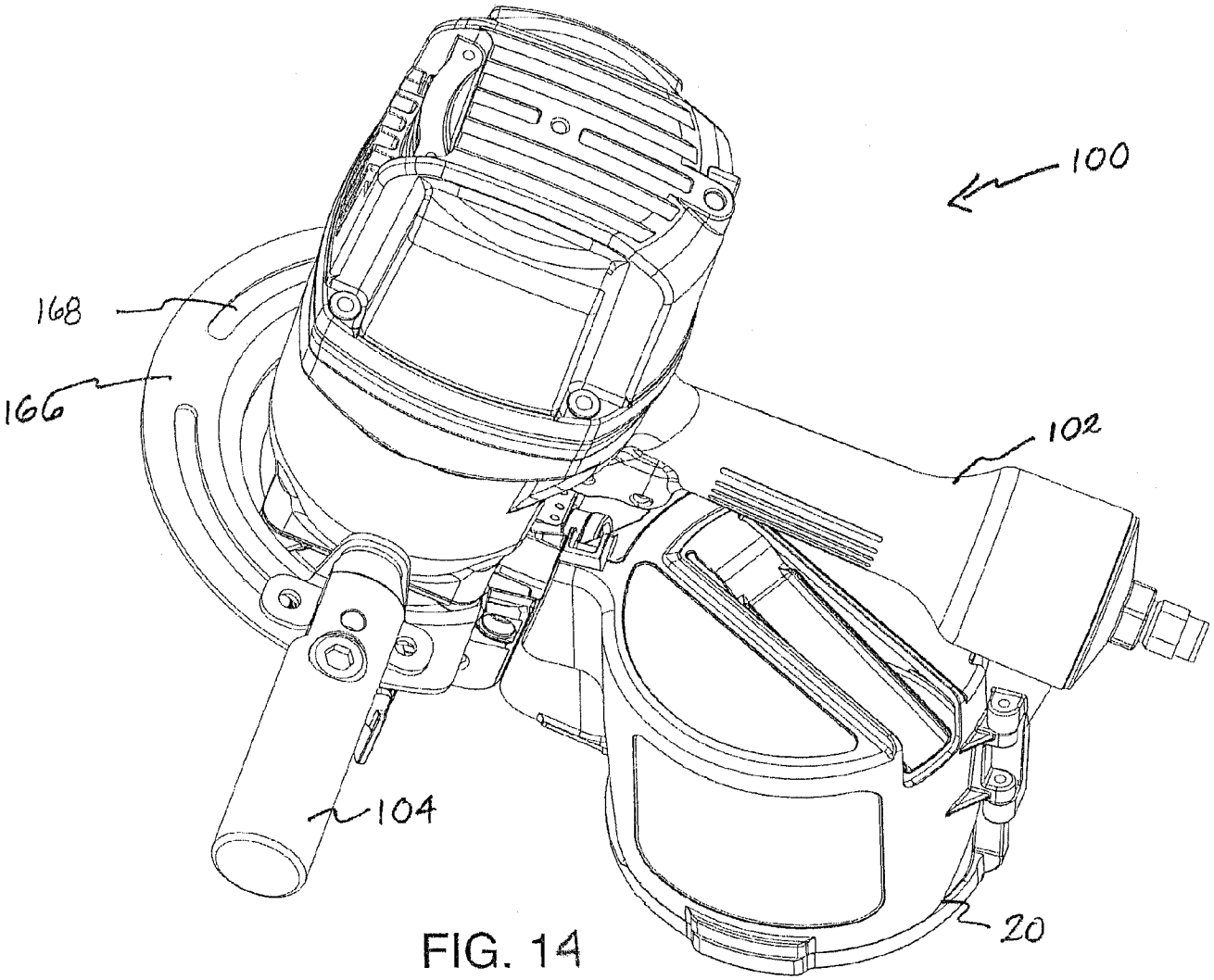
FIG. 14 is a top perspective view of an embodiment of the tool fitted with a bracket allowing adjustable auxiliary handle placement.

In another embodiment, as shown in FIG. 14, the fastening tool can be fitted with a bracket in the form of an adjustment ring 166 that allows the user to slidingly adjust the auxiliary handle 104 around the housing body 12*a*. The adjustment ring 166 is shown as mounted to the housing body 12*a* and circumscribing the base portion 13. The adjustment ring 166 includes a pair of internal slots 168 oriented radially inward from the outer edge of the ring. The auxiliary handle 104 can slide along the slots until the desired position is reached, at which point the auxiliary handle can be secured in place. The auxiliary handle orientation illustrated in FIG. 12 can be achieved with the adjustment ring illustrated in FIG. 14.

Figure 15:
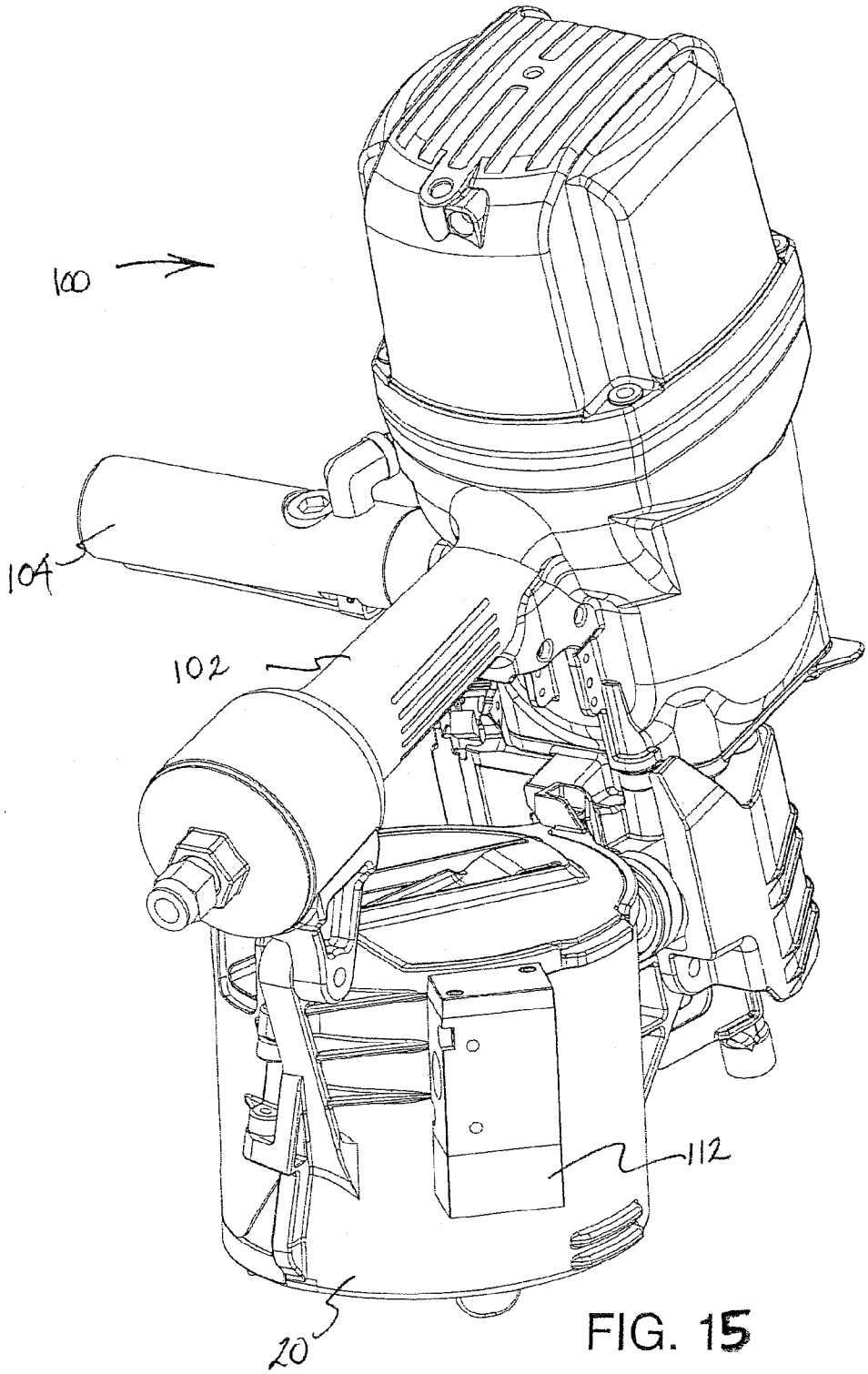
FIG. 15 is a rear perspective view of an embodiment of the tool having a control valve mounted on the fastener canister.
Figure 16:
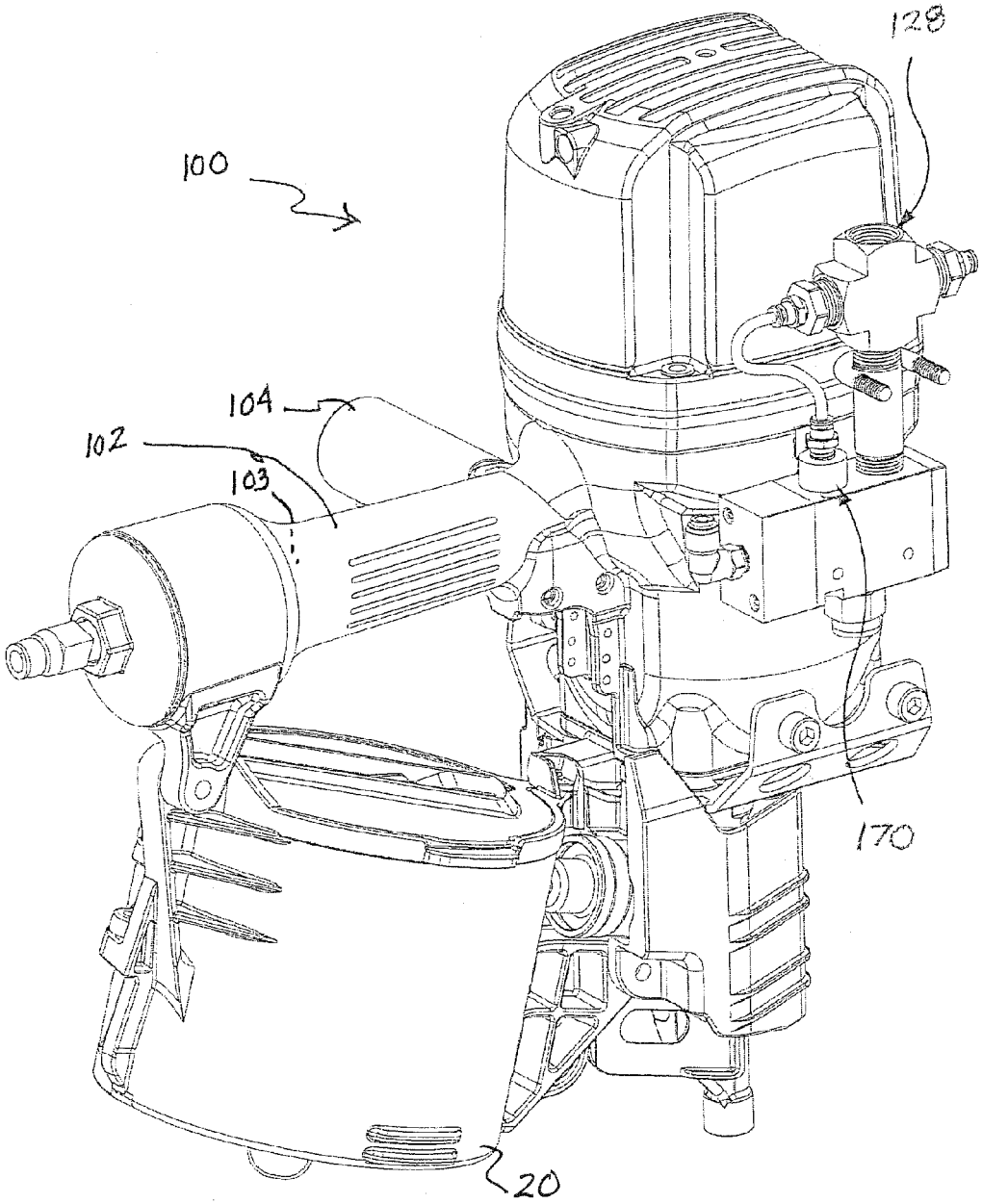
FIG. 16 is a rear perspective view of an embodiment of the tool having an auxiliary valve with a check valve, bracket removed.

In addition to the auxiliary handle arrangements, the fastening tool 100 can also support different valve arrangements. For example, the control valve 112 and associated air fittings can be positioned on the housing body in a manner that protects them from damage. For example, as shown in FIG. 5, the control valve and associated fittings are mounted between the housing body and the second plate of the mounting bracket and are thereby protected from damage. FIG. 15 further illustrates the control valve 112 mounted to the fastener coil magazine or canister 20, which is a location that is naturally protected from and/or less prone to the abuses of normal use as the control valve is closer to the user's body.

FIGS. 16-19 illustrate another embodiment of the present invention in which a check valve assembly 170 is incorporated into the control valve 112 to control air consumption of the fastening tool.

Excessive air consumption can affect not only the tool being used but also other tools in the facility. If a tool uses more air than the air system in the facility can supply, the tool could misfire and not fully drive the fastener into a workpiece. In addition, the fastener driving element or magazine pusher could skip the leading fastener, thereby reducing the efficiency and productivity of the fastening operation. Other equipment using compressed air within the plant/facility could also be negatively impacted. Moreover, an industrial facility would need to add compressed air capacity to compensate for decreased productivity which would increase plant operating costs.

Figure 1:
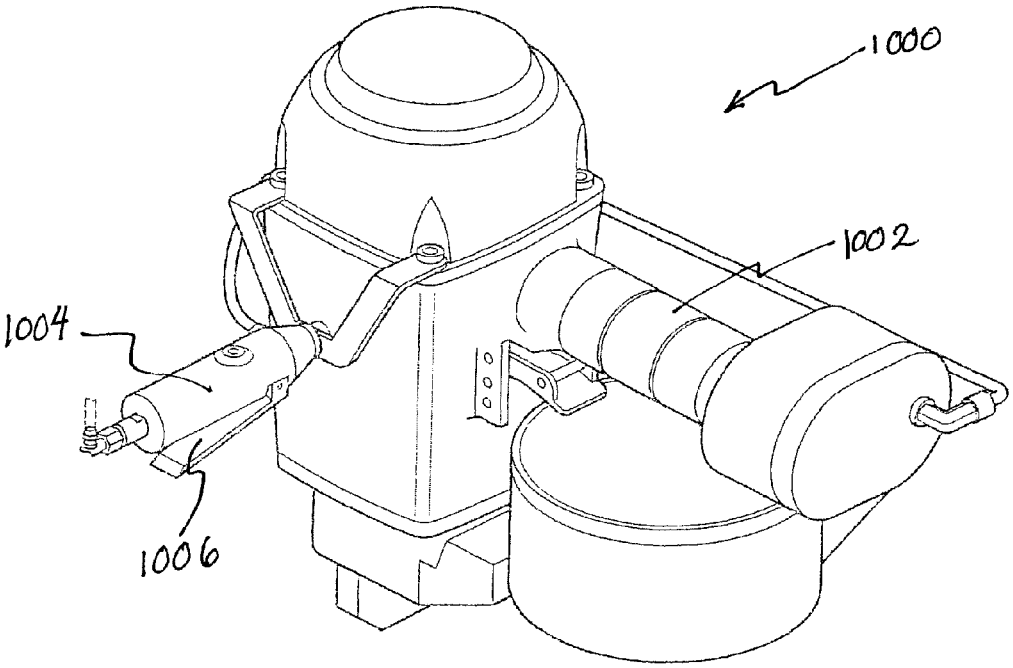
FIG. 1 is a perspective view of a related pneumatic fastener.
Figure 2:
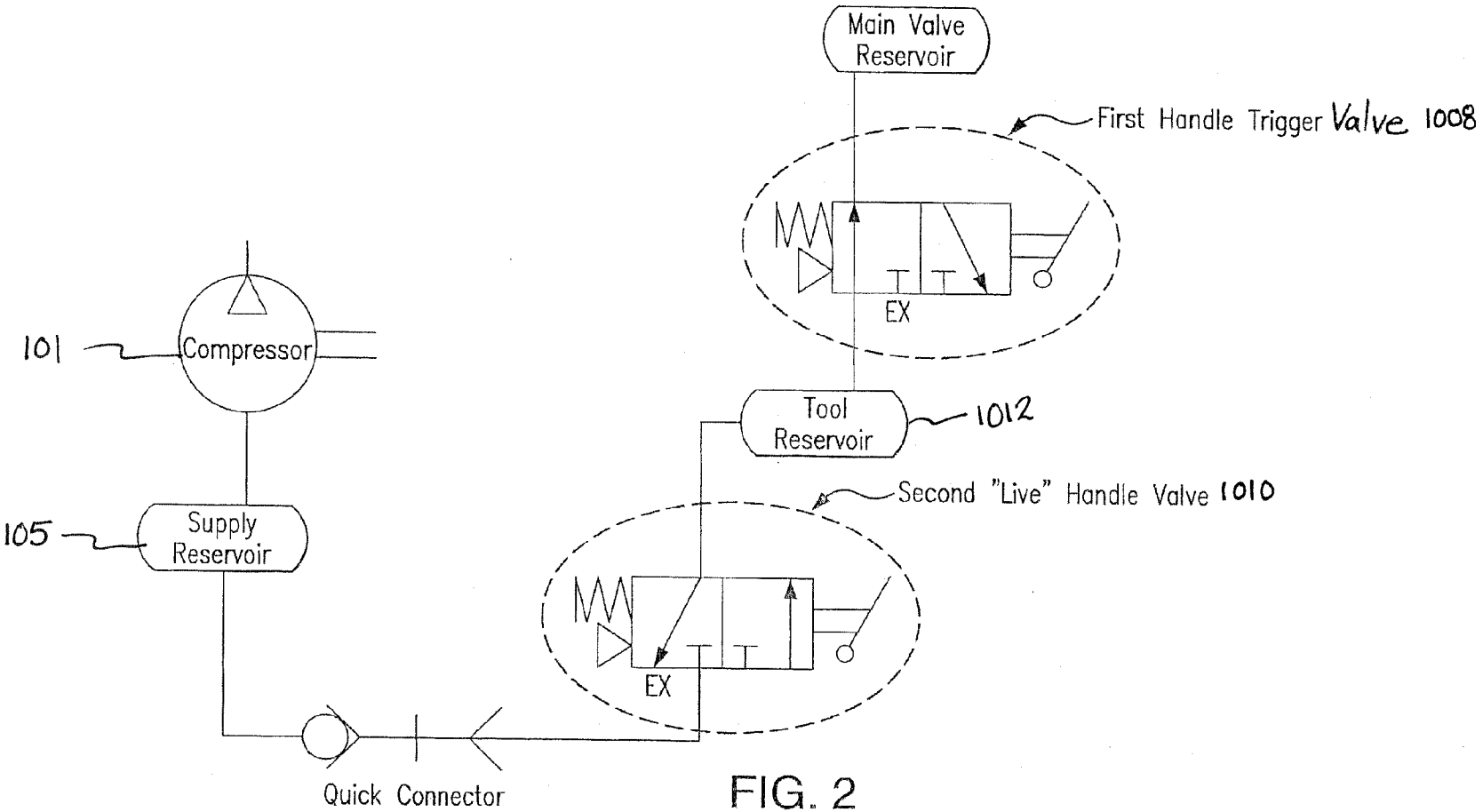
FIG. 2 is a functional schematic of tool of FIG. 1.
Figures 1, 17:
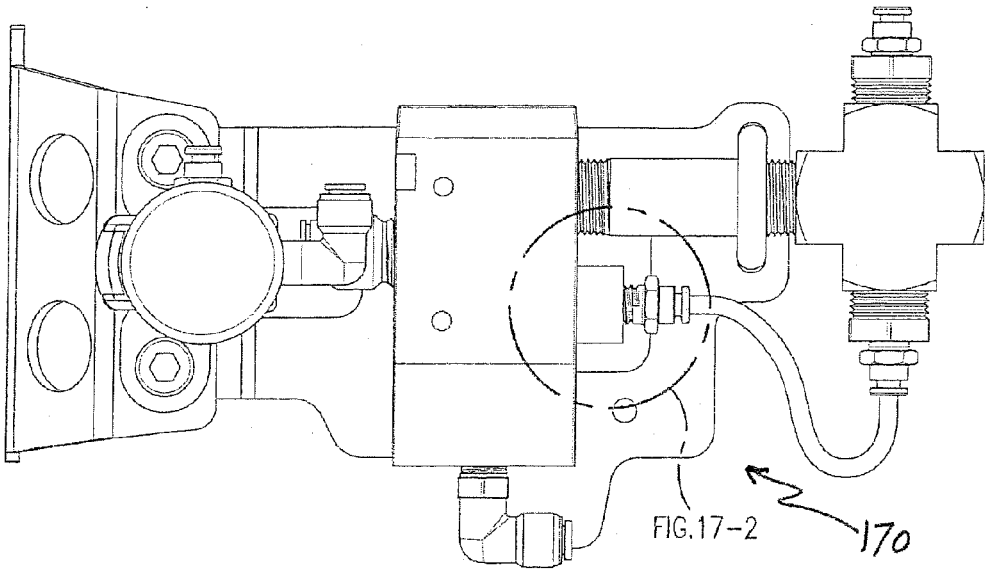
Figures 2, 17:
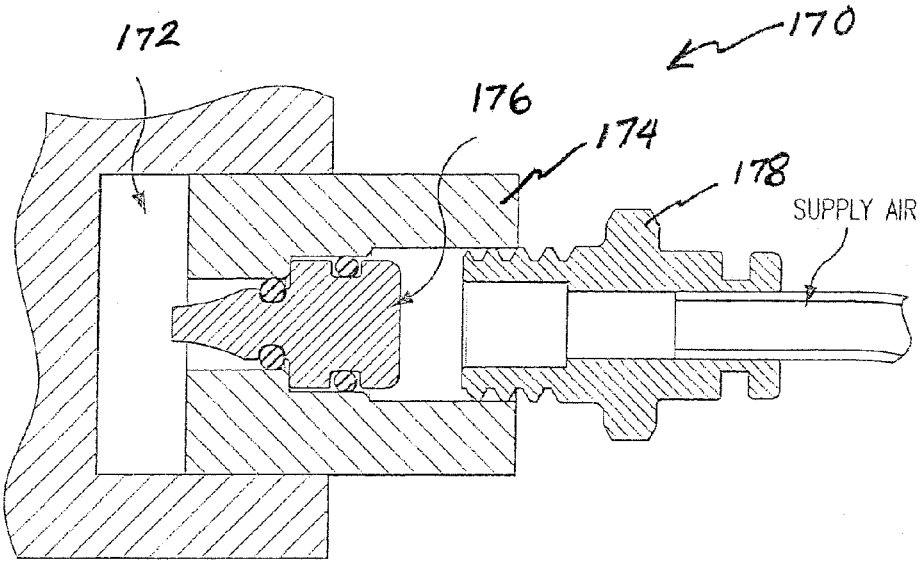
Figure 18:
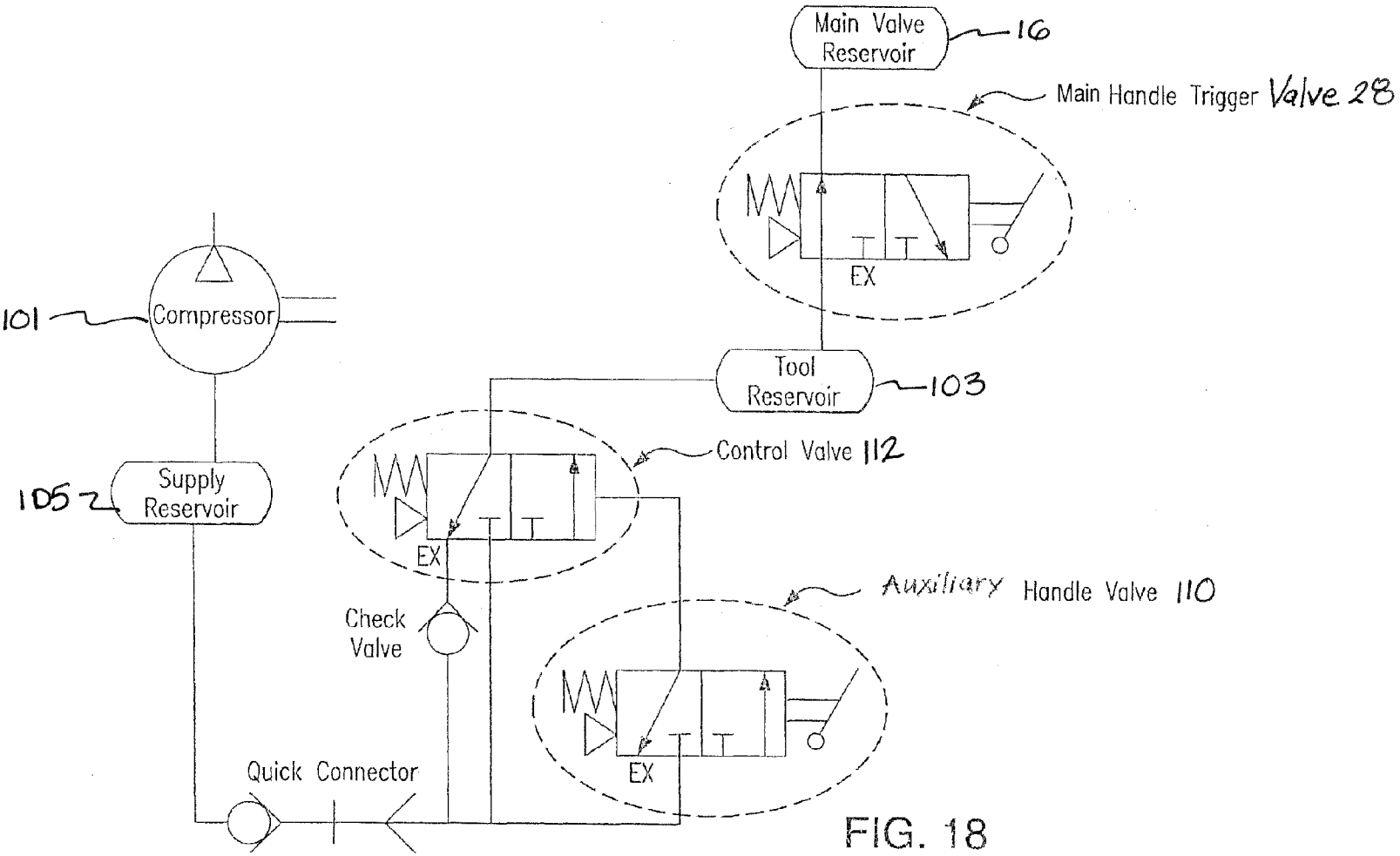
FIG. 18 is a functional schematic of an embodiment of the tool having an auxiliary handle and control valve with a check valve.

In this embodiment, as illustrated in FIGS. 17-1 and 17-2, when the auxiliary handle lever 106 pulled and released, the compressed air in the tool reservoir 103 of the main handle 102 is vented to atmosphere through a control valve exhaust port 172. The check valve 174 having a check valve shuttle 176 serves to block the exhaust port 172 of the control valve and prevent the tool reservoir 103 from dumping air to atmosphere; however, the illustrated air supply quick connect 178 can be decoupled from the check valve 174, so that air can be vented from the entire system to atmosphere. The tool reservoir volume can also be vented to atmosphere through the check valve 174.

The embodiments of FIGS. 16-19 effectively have the same air consumption as the tool 1000 shown in FIG. 1, which is operated without the auxiliary handle valve. One functional difference is that after the first fastener is driven, air is trapped in the tool reservoir. As a result, before the pressure in the tool reservoir drops below the minimum functional value, one or two fasteners could be driven from the fastening tool without having to pull the second handle lever 1006, thus increasing a perceived accident risk.

Figure 19:
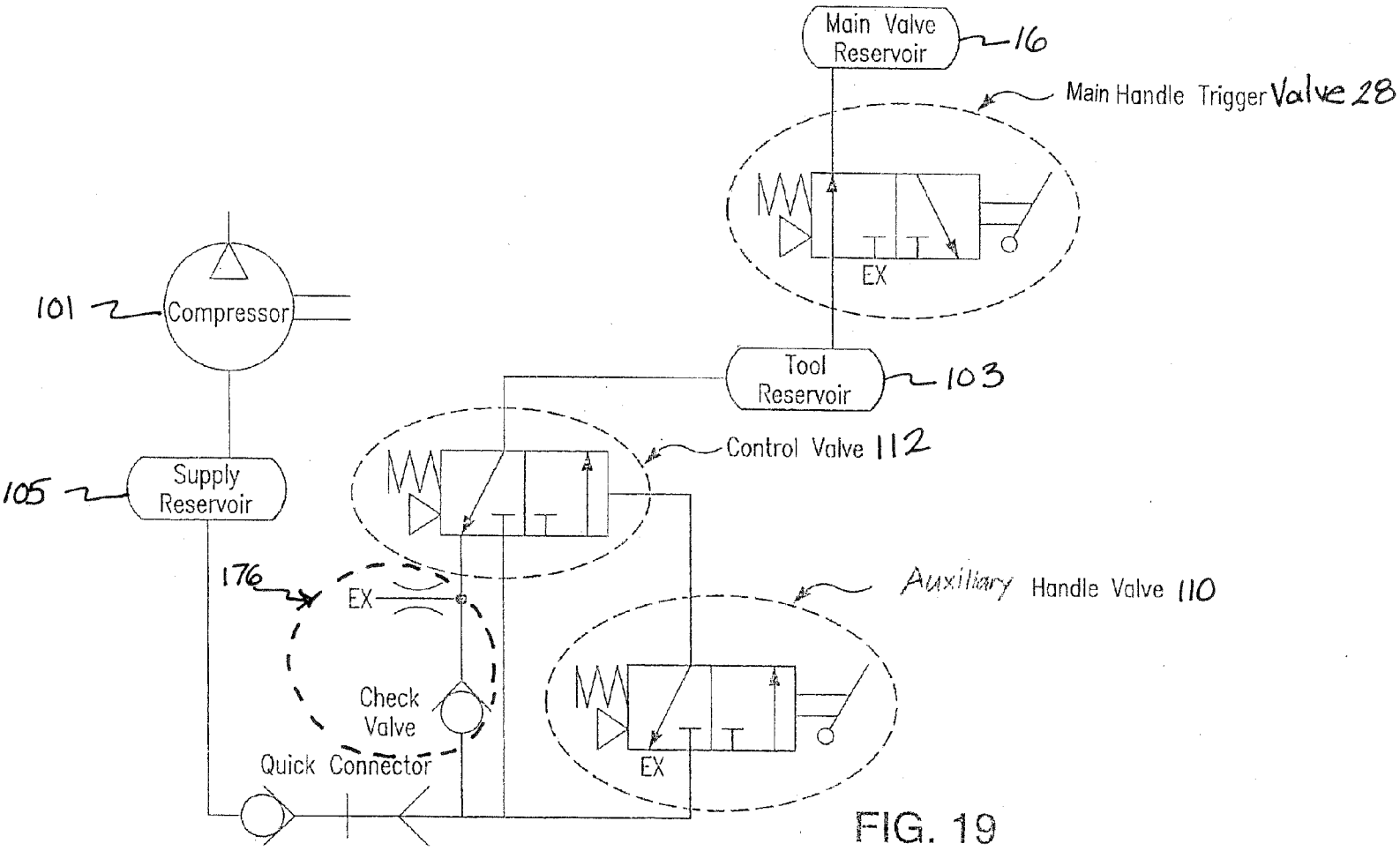
FIG. 19 is a functional schematic of an embodiment of the tool having an auxiliary handle and control valve with a check valve and orifice.

In order to reduce the perceived risk, air trapped in the tool reservoir 103 must be released. To release the air trapped in the tool reservoir, an exhaust member as shown in FIGS. 17-2 and 19, can be added to the tool. The exhaust member can have a fixed orifice opening, as shown, or an orifice opening that can have a variable size. With an exhaust member disposed in the tool, the tool reservoir can be vented to atmosphere at a desired rate of flow depending on the opening size of the orifice. For example, a smaller orifice opening would vent more slowly than a larger orifice opening. Depending on the frequency of the nailing operation, considerable air loss can be avoided and the perceived accident risk minimized.

Air consumption can also be reduced by controlling the volumes of different elements within the tool in addition to the tool reservoir volume in the main handle 102. Such elements, include, but are not limited to, the size of the cylinder, the size of the piston and the displacement volume.

Figure 20:
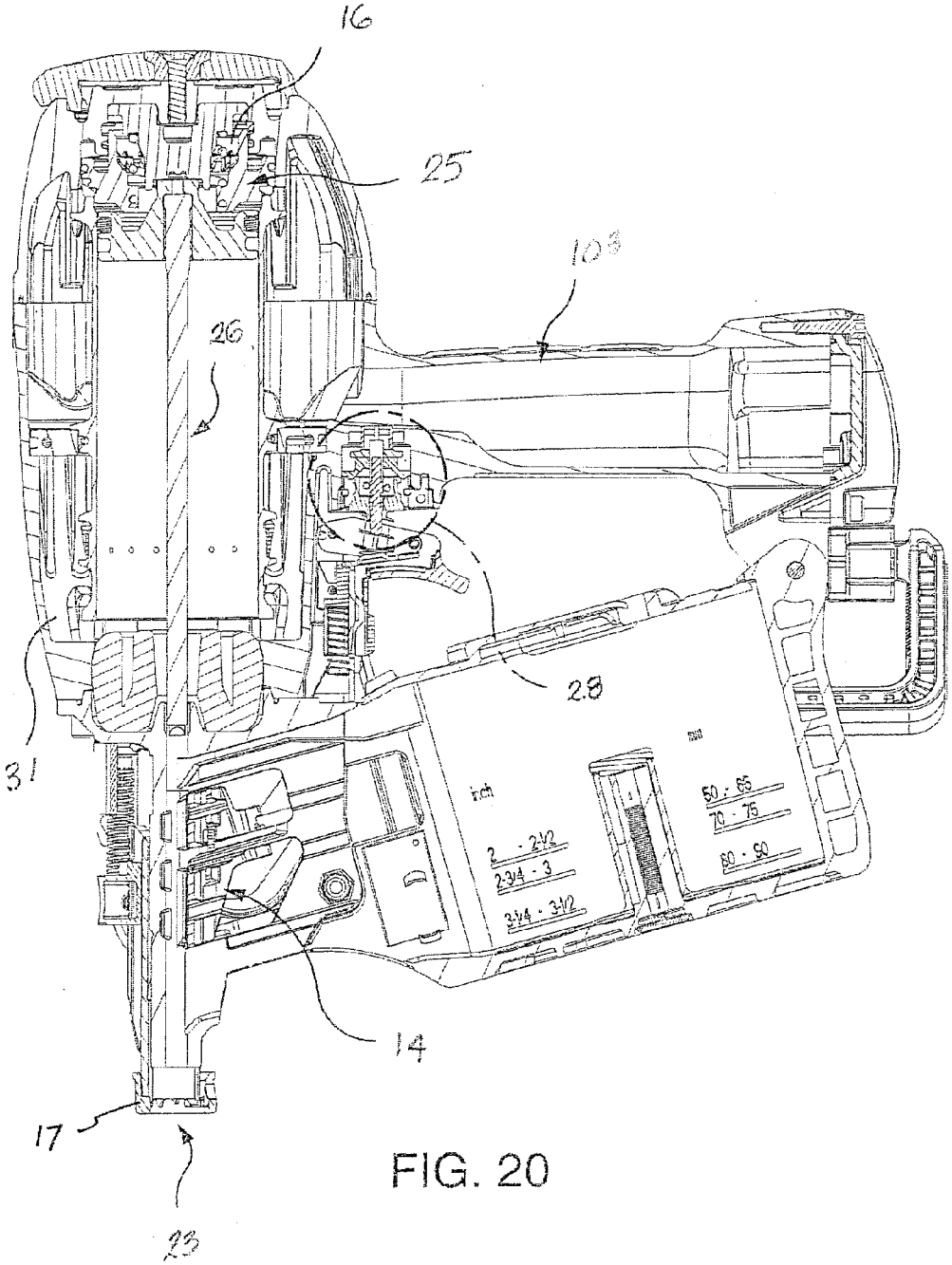
FIG. 20 is a cross-sectional view of a pneumatic fastener.
Figure 21:
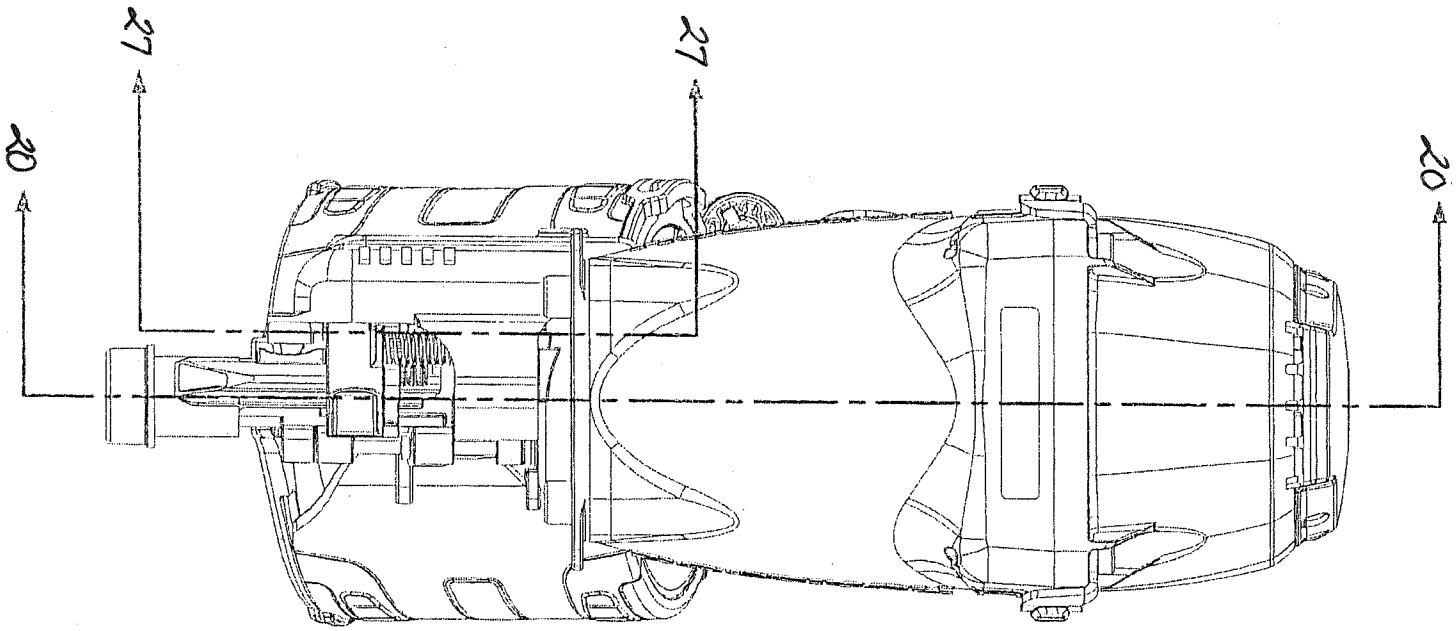
FIG. 21 is a front view detailing cross-sectional locations.

FIG. 20 is a cross-sectional view of a fastening tool showing the different internal volumes and relevant functional parts as detailed below for FIGS. 22 and 23. FIG. 21 is a base view showing the section lines for FIGS. 20 and 27.

Figure 22:
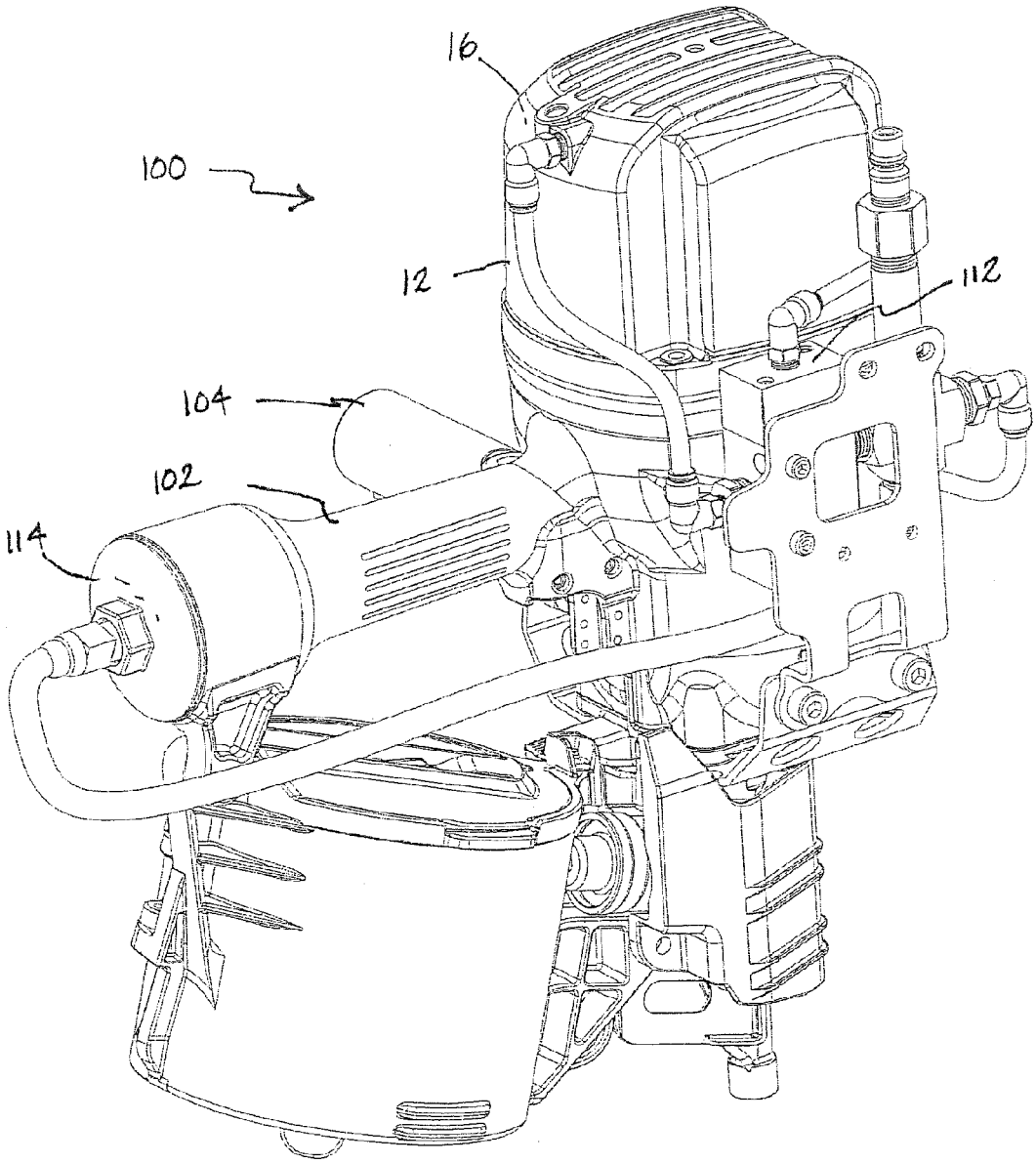
FIG. 22 is a perspective view of an embodiment of the tool having an auxiliary valve connected to the main valve reservoir.
Figure 23:
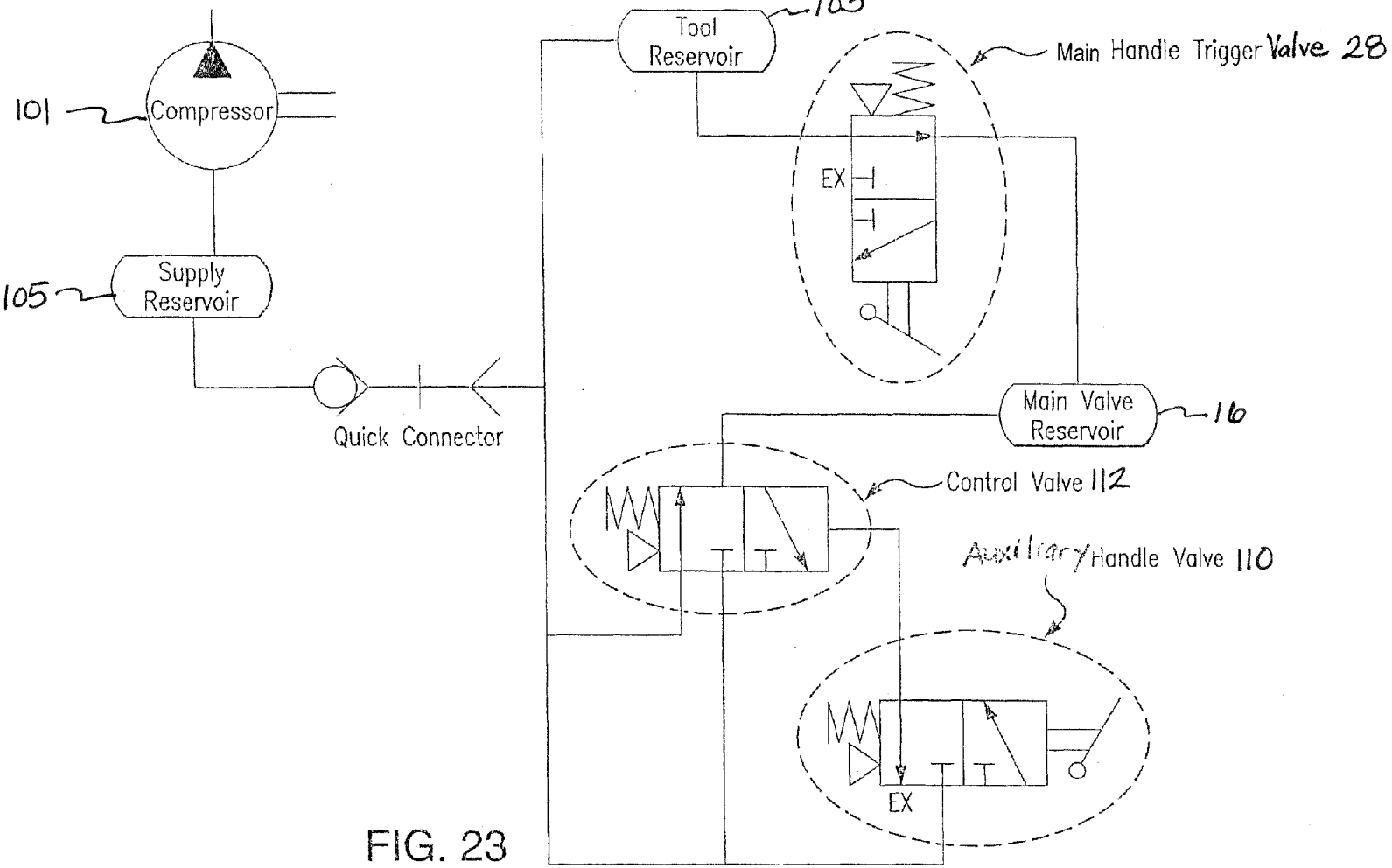
FIG. 23 is a functional schematic of an embodiment of the tool having an auxiliary handle and control valve connected to the main valve reservoir.

FIG. 22 illustrates a rear perspective view of the tool showing a control valve connected to the main valve reservoir. Specifically, FIGS. 22 and 23 illustrate an embodiment of the fastening tool 100 wherein the control valve 112 only supplies compressed air to the main valve reservoir 16 in the tool housing assembly 12. The main valve 25 is controlled by the trigger valve 28 in the main handle 102 of the tool 100. When the trigger 46 is pulled and the trigger valve 28 is activated, compressed air in the main valve reservoir 16 is vented to atmosphere, opening the main valve 25 and starting the fastener drive cycle. The control valve 112 is shown in the functional schematic of FIG. 23, in an at-rest position, and provides a second supply of air to the main valve 25. The first supply of air to the main valve 25 is directly from the air compressor. The control valve 112 supplies the main valve reservoir 16 with compressed air when the trigger valve 28 is activated, to close the main valve 25 and prevent the main valve from actuating. When the auxiliary handle lever 106 is pulled and the handle valve therein activated, the control valve 112 no longer provides the second air supply to the main valve reservoir 103. When the trigger 46 is pulled and the trigger valve 28 actuated, the main valve 25 is opened to start the fastener drive cycle.

Figure 24:
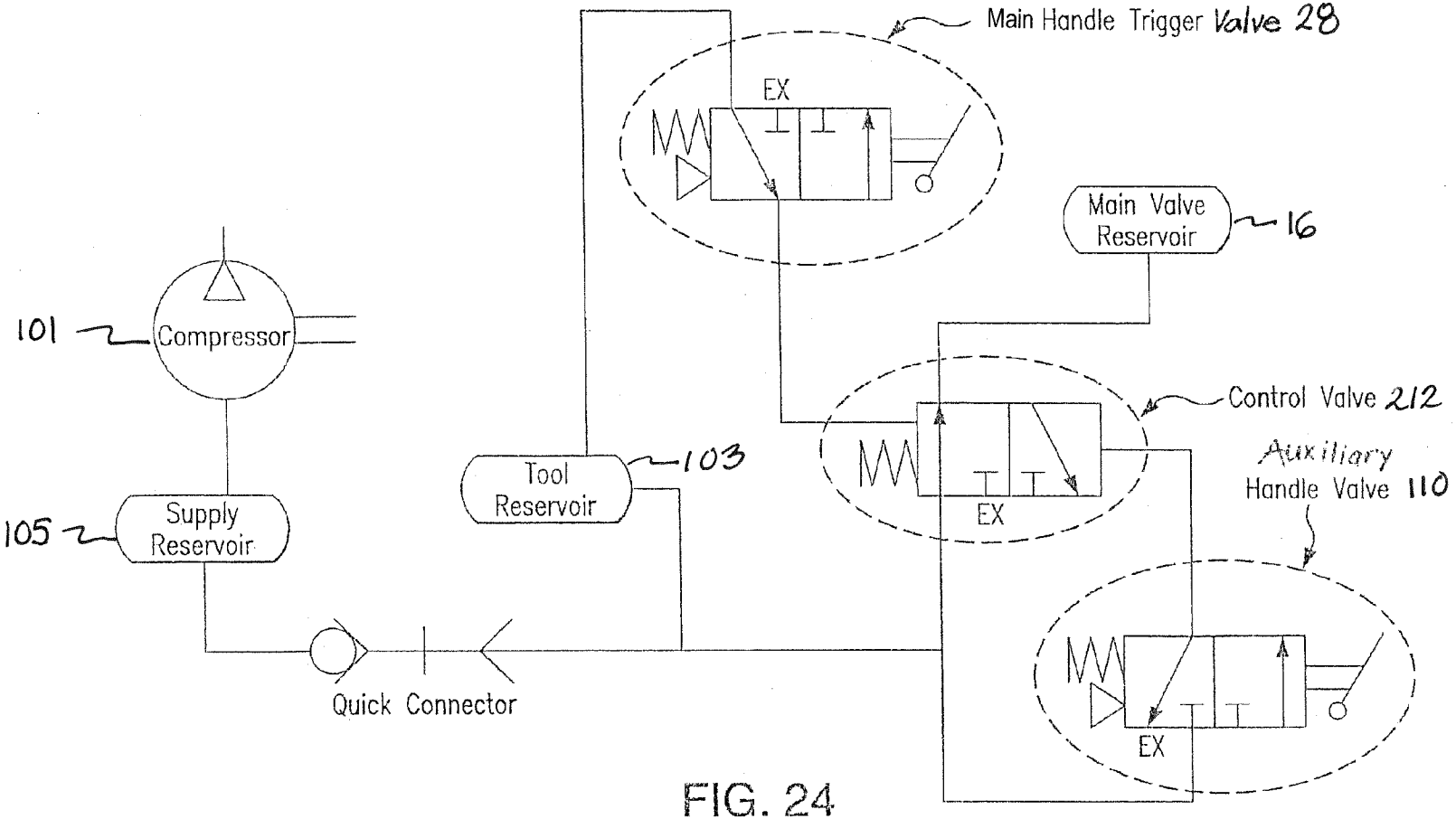
FIG. 24 is a functional schematic of an embodiment of the tool having an auxiliary handle and control valve in line with main valve supply.

The functional schematic shown in FIG. 24 illustrates another embodiment of the present invention in which a flow control valve is a dual pilot control valve 212. In the dual pilot control valve, the trigger valve 28 controls one pilot (the first pilot) and the auxiliary handle valve controls the other pilot (the second pilot). In the normal state, the main valve reservoir 16 is supplied with air through the control valve 212, the trigger valve 28 supplies pressure to the first pilot so that the control valve is activated to supply air to the main valve 25. Activating the auxiliary handle valve balances the pilot force, but does not activate the control valve. The control valve 212 is activated when the trigger valve 28 is activated (removing the pilot pressure), then when the auxiliary handle valve 110 is activated, air is supplied to the other pilot that overcomes the spring bias. When both the auxiliary handle valve and the trigger valve 28 are simultaneously activated, the main valve reservoir 16 can be vented to atmosphere to start the fastener drive cycle.

Figure 25:
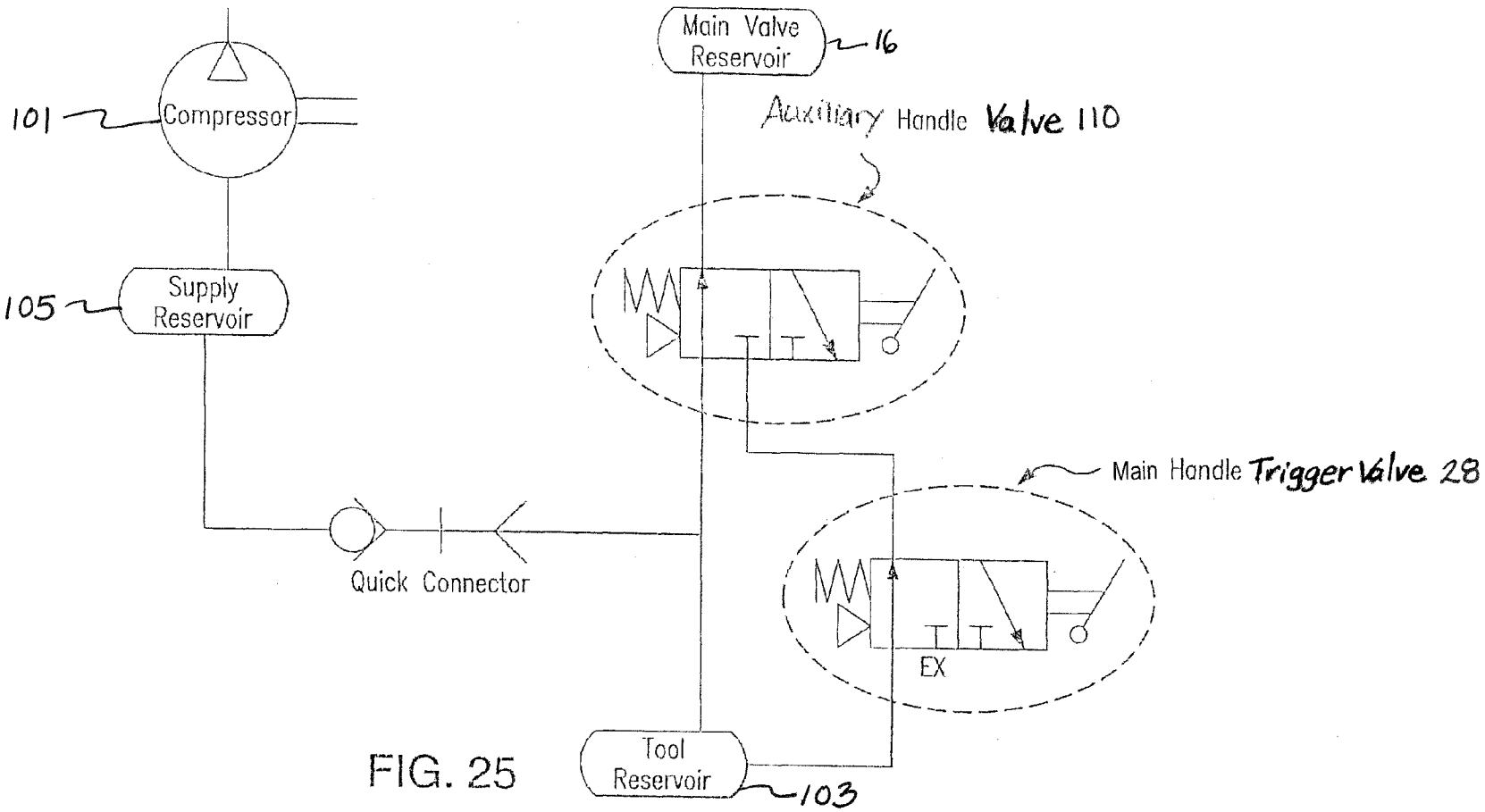
FIG. 25 is a functional schematic of an embodiment of the tool having alternate auxiliary handle and in line with main valve supply.
Figure 26:
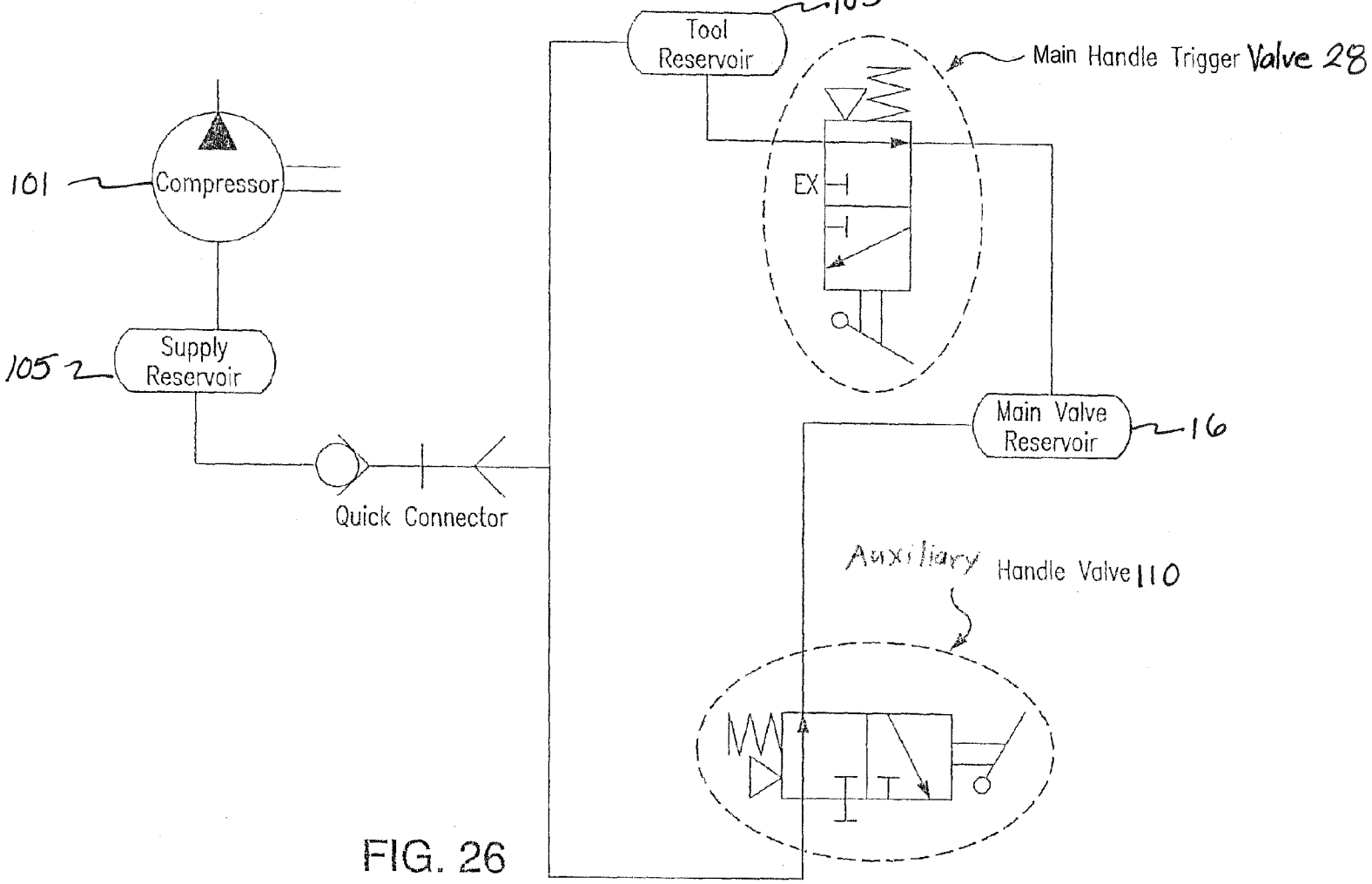
FIG. 26 is a functional schematic of an embodiment of the tool having alternate auxiliary handle connected to the main valve reservoir.

FIG. 25 is an alternate functional schematic of that shown in FIG. 24 wherein compressed air flows freely and directly to the tool reservoir 103 without flowing through a control valve. Because the tool reservoir 103 is not being controlled by a control valve, a large air flow rate through the control valve is not required. A configuration change of the auxiliary handle valve allows the same function without the control valve. FIG. 26 also illustrates that the compressed air can flow from the air compressor directly to the tool reservoir 103 without flowing through a control valve. Compressed air can also flow to the auxiliary handle 104. The auxiliary handle valve 110 is activated to close the fastening tool circuit and activate the tool.

Figure 27:
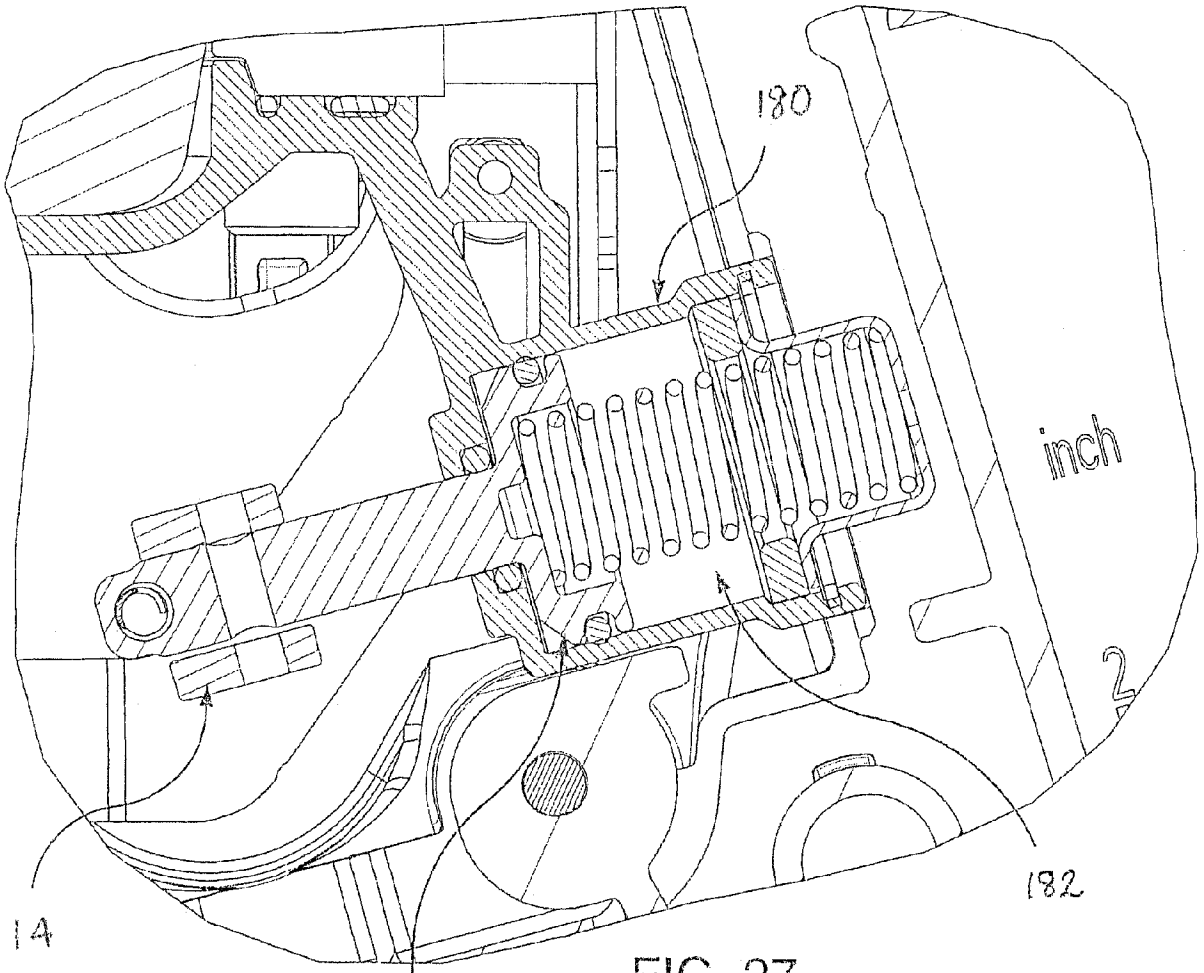
FIG. 27 is a cross-section view of a fastener feed cylinder.
Figure 28:
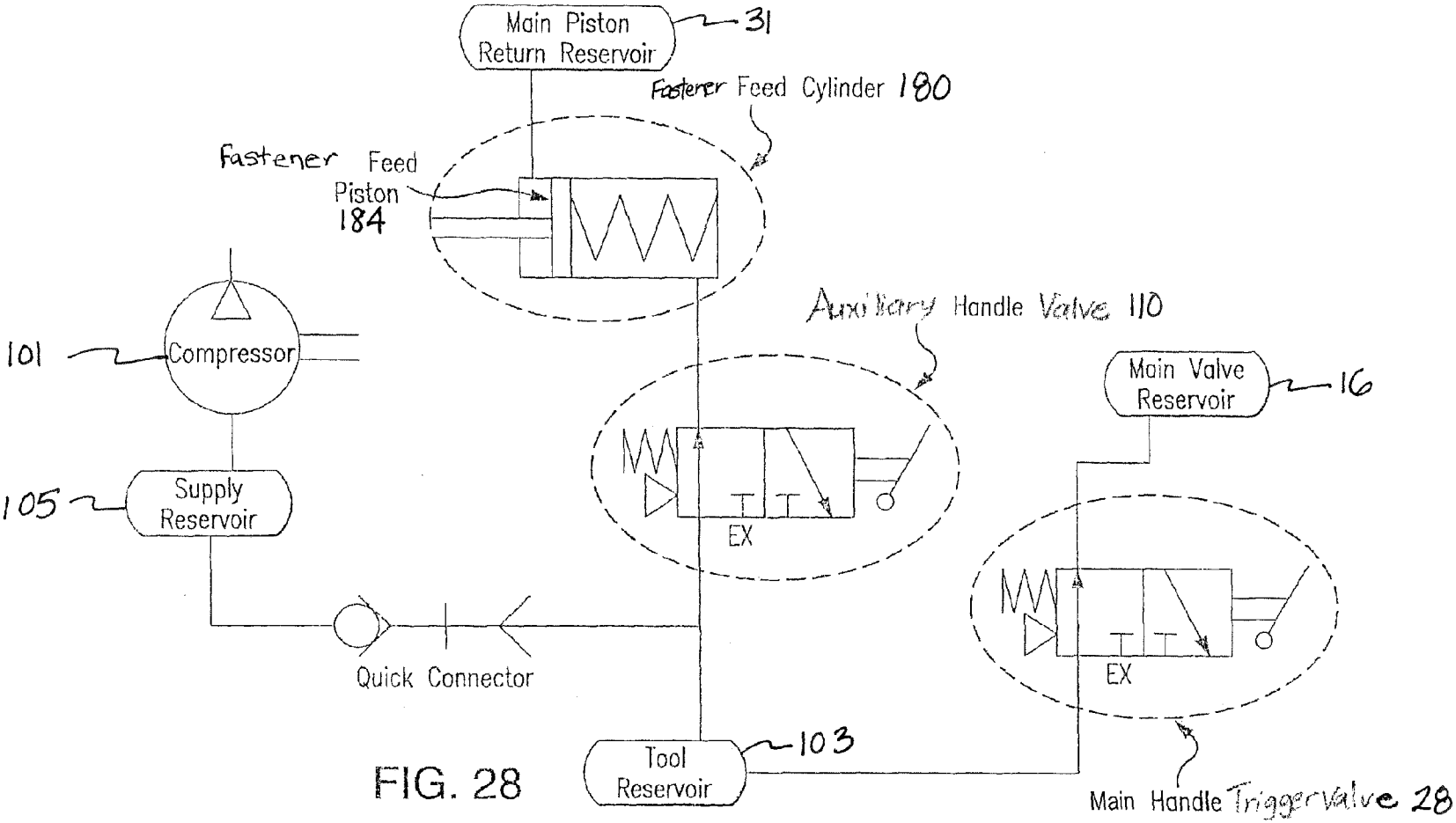
FIG. 28 functional schematic of an embodiment of the tool having an auxiliary handle and control valve connected to the fastener feed cylinder.

Referring now to the feeding of fasteners, industrial fastening applications often use a coil magazine or canister for pneumatic fastening tools because more fasteners can be carried in the canister than in a linear magazine. FIG. 27 is a cross-sectional view of a pneumatic coil fastening tool showing the fastener feed cylinder 180 that advances the fasteners into position to be driven into a workpiece. Supply air is directed to one side 182 of a feed piston 184 by the auxiliary handle to block the feed piston from retracting. FIG. 28 is a functional schematic of the feed piston control in a feed cylinder fastener. The feed piston pushes the nails into the drive track for engagement with the fastener driving element.

As shown in FIG. 28 the auxiliary handle 110, when open, supplies compressed air to the spring side of the feed piston 184 which prevents the feed piston from retracting. The feed piston 184 must retract in order to grab the next fastener and push the fastener forward into the drive track 18. Activating the auxiliary handle valve 110 by pulling the auxiliary handle lever 106 vents the pressure behind the feed piston 184 to atmosphere and unblocks the feed piston so that the feed piston can freely advance and retract.

The auxiliary handle valve 110 and the control valve 112 have been described herein and illustrated as either mechanically or pneumatically activated. Although mechanical actuation is disclosed, the signal to change position that the auxiliary handle sends to the control valve does not need to be a pneumatic signal. The signal can be electrical and the control valve(s) described can be solenoid operated. The auxiliary handle valve 110 can be designed to send an electrical signal to the control valve 112 powered by an external source or through an internal power source such as battery.

In addition to the electronics disclosed above, one skilled in the art can readily understand that various sensors, such as, for example, pressure sensors and proximity sensors can be used in place of the mechanical lever on the auxiliary handle 104. Sensors reduce the force required to activate the auxiliary handle. Additional electronics can be included to add timing functions. For example, a timer can be added so that the auxiliary handle self-deactivates after a predetermined period of time. In addition, after the auxiliary handle has been released (deactivated), a timer can keep the signal in an "ON" state for predetermined period of time, as a means to reduce air consumption if the control valve is controlling the tool reservoir volume.

In operation, the fastening tool 100 of the present invention has plural power source ports. The tool includes housing body 12*a* of a housing assembly 12 and a first or main handle 102 coupled to the housing body. The main handle 102 defines a first inlet for supplying compressed gas to the housing cylinder 21. The auxiliary handle 104 defines a second inlet for supplying compressed gas to the housing assembly 12. The auxiliary handle 104 can be mounted proximal to the nosepiece 177 of the fastening tool which provides improved fastening operation control. The auxiliary handle 104 can be arranged in non-parallel, non-planar or planar relation to the first handle. A main handle trigger valve 28 having a depressible first actuator 44, in the form of, for example, a pin, communicates with the first inlet 114 of the main handle 102 and is configured to initiate actuation of the tool. The trigger 46 is configured to depress the first actuator 44. The auxiliary handle valve or lever valve 110, having a depressible second actuator, in the form of for example, a pin, is in communication with the second inlet of the auxiliary handle 104 and configured to complete actuation of the tool.

A pivotable lever 106 is configured to contact the auxiliary handle valve 110 and depress the second actuator therein. A contact trip is constructed and arranged to be moved from a normally biased inoperative position into an operative position when the contact trip is pressed against the workpiece. A fastener driving assembly is disposed within the housing assembly 12 and includes a cylinder 21 and a piston 24 that reciprocate within the cylinder to drive a fastener. The piston is coupled to the fastener driving assembly.

Actuation of the piston 24 causes compressed gas to drive the piston within the cylinder 21 to drive the fastener. The plurality of power source ports in the tool 100 include an opening 114 in communication with the trigger valve 28 and an opening in communication with the auxiliary handle or lever valve 110 for delivering the compressed gas from the auxiliary handle 104 to the main handle 102 to a region above the piston 24 upon depression of the first actuator 44 and the second actuator valve in 110.

Contemporaneous depression of the first actuator, the second actuator and the contact trip actuates the pneumatic fastening tool to drive the fastener.

The present invention has a number of advantages including but not limited to providing high-speed fastening in the industrial application of the construction and repair of pallets, for example. Other industrial applications include those in which the tool is tethered to/mounted in a predetermined work zone and the work material is brought into and removed from the work zone. Such industrial applications provide that the work material to be fastened is fixed in position such that two-handed fastening is practical in a repetitive fastening operation. Industrial applications where the tool is in a predetermined location and the work material is brought to and removed from the work zone include, but are not limited to, the construction of modular housing, manufactured housing, recreational vehicles, trusses, and fencing. Industrial applications further include furniture framing, bedding and mattress manufacturing, and millwork and door and window fabrication.

While aspects of the present invention are described herein and illustrated in the accompanying drawings in the context of a pneumatic fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

We claim:

1. A fastening tool comprising:

a housing assembly including a housing body having a longitudinal axis;

a cylinder disposed within the housing body;

a piston slidably sealingly mounted in the cylinder for movement through an operative cycle including a drive stroke and a return stroke;

a fastener driving assembly disposed within the housing assembly, the fastener driving assembly including a fastener driving element connected to the piston for movement through a drive stroke in response to the drive stroke and return stroke of the piston;

a nose portion defining a fastener drive track for movement of the fastener driving element aligned with the fastener driving assembly;

a contact trip constructed and arranged to be moved from a normally biased inoperative position into an operative position when pressed against a workpiece;

a first handle attached to the housing body, the first handle defining a tool reservoir;

a control valve mounted to the housing body for controlling an amount of compressed gas to the tool reservoir;

a second handle coupled to the housing body for supplying compressed gas to the control valve;

a trigger valve in communication with the tool reservoir and configured to initiate actuation of the fastening tool;

a manually operated valve within the second handle configured to complete actuation of the fastening tool; and wherein the compressed gas flows through the control valve to the tool reservoir to fill a region above the piston upon actuation of the trigger valve, the manually operated valve, and the contact trip.

2. The fastening tool according to claim 1, wherein the manually operated valve is a lever valve.

3. The fastening tool according to claim 1, wherein the control valve is an air pilot-operated control valve.

4. The fastening tool according to claim 3, wherein the control valve includes a piston.

5. The fastening tool according to claim 1, further comprising an auxiliary hose for delivering a gas from the second handle to the control valve.

6. The fastening tool according to claim 1, wherein the control valve is mounted to an outer side surface of the housing body.

7. The fastening tool according to claim 1, wherein the control valve is mounted to a bracket that is mounted to a housing body.

8. The fastening tool according to claim 1, further comprising a fastener coil canister magazine carried by the housing assembly for feeding successive fasteners laterally into the drive track to be driven therefrom by the fastener driving element during the drive stroke thereof.

9. The fastening tool according to claim 8, wherein the control valve is mounted to the canister.

10. A fastening tool comprising:

a housing assembly including a housing body having a longitudinal axis;

a cylinder disposed within the housing body;

a piston slidably sealingly mounted in the cylinder for movement through an operative cycle including a drive stroke and a return stroke;

a fastener driving assembly disposed within the housing assembly, the fastener driving assembly including a fastener driving element connected to the piston for movement through a drive stroke in response to the drive stroke and return stroke of the piston;

a nose portion defining a fastener drive track for movement of the fastener driving element aligned with the fastener driving assembly;

a contact trip constructed and arranged to be moved from a normally biased inoperative position into an operative position when pressed against a workpiece;

a first handle attached to the housing body, the first handle defining a tool reservoir;

a control valve mounted to the housing body for controlling an amount of compressed gas to the tool reservoir;

a second handle coupled to the housing body for supplying compressed gas to the control valve;

a trigger valve in communication with the tool reservoir and configured to initiate actuation of the fastening tool;

a manually operated lever valve within the second handle configured to complete actuation of the fastening tool;

wherein the compressed gas flows through the control valve to the tool reservoir to fill a region above the piston upon actuation of the trigger valve, the lever valve, and the contact trip; and wherein the second handle is at least one of adjustable and repositionable.

11. The fastening tool according to claim 10, further comprising a bracket mounted to the housing body, the second handle being mounted to the bracket.

12. The fastening tool according to claim 11, wherein the bracket comprises a first plate that is connected to a base portion of the housing body and a second plate that is connected to the first plate and extends parallel to a longitudinal axis of the housing body.

13. The fastening tool according to claim 11, wherein the bracket comprises an adjustment ring circumscribing a portion of the housing body, the adjustment ring having internal slots for slidingly positioning the second handle around the housing body.

14. The fastening tool according to claim 13, wherein the internal slots are oriented radially inward from an outer edge of the adjustment ring.

* * * * *